US012116909B2

(12) United States Patent
Hughes et al.

(10) Patent No.: US 12,116,909 B2
(45) Date of Patent: Oct. 15, 2024

(54) AUXILIARY FRAMEWORK FOR ELECTRICALLY LATCHED ROCKER ARMS

(71) Applicant: Eaton Intelligent Power Limited, Dublin (IE)

(72) Inventors: Douglas Anthony Hughes, Novi, MI (US); Matthew Richard Busdiecker, Beverly Hills, MI (US); Dale Arden Stretch, Novi, MI (US); Petr Liskar, Prague (CZ); Jiri Cecrle, Prague (CZ); Michael J. Campbell, Scotts, MI (US)

(73) Assignee: Eaton Intelligent Power Limited, Dublin (IE)

( * ) Notice: Subject to any disclaimer, the term of this patent is extended or adjusted under 35 U.S.C. 154(b) by 606 days.

(21) Appl. No.: 16/342,353

(22) PCT Filed: Oct. 16, 2017

(86) PCT No.: PCT/US2017/056762

§ 371 (c)(1),
(2) Date: Apr. 16, 2019

(87) PCT Pub. No.: WO2018/075392

PCT Pub. Date: Apr. 26, 2018

(65) Prior Publication Data

US 2021/0372298 A1 Dec. 2, 2021

Related U.S. Application Data

(63) Continuation-in-part of application No. 15/432,026, filed on Feb. 14, 2017, now Pat. No. 11,002,156,
(Continued)

(51) Int. Cl.
*F01L 1/18* (2006.01)
*F01L 1/24* (2006.01)
(Continued)

(52) U.S. Cl.
CPC ..... *F01L 1/185* (2013.01); *F01L 1/24* (2013.01); *F01L 1/267* (2013.01);
(Continued)

(58) Field of Classification Search
CPC ... F01L 1/185; F01L 1/24; F01L 1/267; F01L 13/0005; F01L 2001/186; F01L 2001/187;
(Continued)

(56) References Cited

U.S. PATENT DOCUMENTS 3,040,217 A 6/1959 Conrad
4,203,397 A * 5/1980 Soeters, Jr. ..... F01L 1/185 123/90.16
(Continued)

FOREIGN PATENT DOCUMENTS

DE 10310220 A1 9/2004
EP 1408203 A2 4/2004
(Continued)

OTHER PUBLICATIONS

International Search Report and Written Opinion for PCT/US2015/045774; mailed Oct. 26, 2015; pp. 1-10.
(Continued)

*Primary Examiner* — Wesley G Harris
(74) *Attorney, Agent, or Firm* — Baker Botts L.L.P.

(57) ABSTRACT

A valvetrain suitable for an internal combustion engine of a type that includes a combustion chamber, a moveable valve having a seat formed within the combustion chamber, and a camshaft. The valvetrain includes a rocker arm assembly having a rocker arm and an electrical device that either configures the rocker arm assembly or provides position feedback for a part of the rocker arm assembly. The valvetrain includes a framework that fits around a spark plug tube while holding a component of a circuit that includes the electrical device in a position adjacent the rocker arm
(Continued)

assembly. The position may place the component in contact with or very close to the rocker arm assembly. This framework structure may effectively utilize the available space under a valve cover while facilitating correct positioning of the component in relation to the rocker arm assembly.

19 Claims, 21 Drawing Sheets

Related U.S. Application Data which is a continuation-in-part of application No. PCT/US2015/045774, filed on Aug. 18, 2015.

(60) Provisional application No. 62/488,747, filed on Apr. 22, 2017, provisional application No. 62/449,174, filed on Jan. 23, 2017, provisional application No. 62/409,263, filed on Oct. 17, 2016.

(51) Int. Cl.
*F01L 1/26* (2006.01)
*F01L 13/00* (2006.01)

(52) U.S. Cl.
CPC ..... *F01L 13/0005* (2013.01); *F01L 2001/186* (2013.01); *F01L 2001/187* (2013.01); *F01L 2301/00* (2020.05); *F01L 2305/00* (2020.05); *F01L 2820/03* (2013.01)

(58) Field of Classification Search
CPC ..... F01L 2301/00; F01L 2305/00; F01L 2820/03; F01L 13/0036; F01L 2013/101; F01L 2820/031; F01L 1/2405; F01L 2013/001; F01L 2201/00; F01L 1/18
USPC ..... 123/198 F, 90.16, 90.41, 90.11
See application file for complete search history.

(56) References Cited

U.S. PATENT DOCUMENTS

| | | | | | |
|---|---|---|---|---|---|
| 4,762,096 | A * | 8/1988 | Kamm | F01L 13/0036 | 123/90.43 |
| 5,080,057 | A * | 1/1992 | Batzill | F02F 1/242 | 123/193.5 |
| 5,544,626 | A * | 8/1996 | Diggs | F01L 1/185 | 123/90.16 |
| 5,619,958 | A * | 4/1997 | Hampton | F01L 1/185 | 123/90.16 |
| 5,896,076 | A | 4/1999 | van Namen | | |
| 6,318,318 | B1 * | 11/2001 | Jahr | F01L 13/0005 | 123/90.16 |
| 6,499,451 | B1 * | 12/2002 | Hendriksma | F01L 1/08 | 123/90.38 |
| 8,448,618 | B2 | 5/2013 | Lee et al. | | |
| 8,985,074 | B2 | 3/2015 | Zurface et al. | | |
| 2003/0200947 | A1 | 10/2003 | Harris | | |
| 2004/0069258 | A1 | 4/2004 | Kaczmarek et al. | | |
| 2005/0161011 | A1 * | 7/2005 | Fujii | F01L 13/0015 | 123/90.16 |
| 2008/0006232 | A1 | 1/2008 | Gregor et al. | | |
| 2008/0178828 | A1 * | 7/2008 | Patel | F01L 13/0031 | 123/90.12 |
| 2010/0307436 | A1 | 12/2010 | Lee et al. | | |
| 2014/0182539 | A1 | 7/2014 | Gron, Jr. et al. | | |
| 2017/0236630 | A1 | 8/2017 | Kank et al. | | |
| 2017/0241300 | A1 | 8/2017 | Liskar et al. | | |
| 2018/0142583 | A1 | 5/2018 | Liskar et al. | | |
| 2018/0195419 | A1 | 7/2018 | Liskar et al. | | |

FOREIGN PATENT DOCUMENTS

| | | | | |
|---|---|---|---|---|
| EP | 2050933 | A1 | 4/2009 | |
| WO | WO-0165093 | A1 * | 9/2001 | F01B 1/12 |
| WO | 2013067506 | A1 | 5/2013 | |
| WO | 2016028812 | A1 | 2/2016 | |
| WO | 2016197088 | A1 | 12/2016 | |

OTHER PUBLICATIONS

International Search Report and Written Opinion for PCT/US2017/056762, mailed Jan. 30, 2018; pp. 1-17.

* cited by examiner

AUXILIARY FRAMEWORK FOR ELECTRICALLY LATCHED ROCKER ARMS

FIELD

The present teachings relate to valvetrains, particularly valvetrains providing variable valve lift (VVL) or cylinder deactivation (CDA).

BACKGROUND

Hydraulically actuated latches are used on some rocker arm assemblies to implement variable valve lift (VVL) or cylinder deactivation (CDA). For example, some switching roller finger followers (SRFF) use hydraulically actuated latches. In these systems, pressurized oil from an oil pump may be used for latch actuation. The flow of pressurized oil may be regulated by an oil control valve (OCV) under the supervision of an engine control unit (ECU). A separate feed from the same source provides oil for hydraulic lash adjustment. In these systems, each rocker arm assembly has two hydraulic feeds, which entails a degree of complexity and equipment cost. The oil demands of these hydraulic feeds may approach the limits of existing supply systems. The complexity and demands for oil in some valvetrain systems can be reduced by replacing hydraulically latched rocker arm assemblies with electrically latched rocker arm assemblies. There is a need for compact and reliable electromagnet latch assemblies for switching and cylinder deactivating rocker arms. There is also a need to provide diagnostic feedback for switching and cylinder deactivating rocker arms.

SUMMARY

The present teachings relate to a valvetrain suitable for an internal combustion engine of a type that includes a combustion chamber, a moveable valve having a seat formed within the combustion chamber, and a camshaft. The valvetrain includes a rocker arm assembly having a rocker arm and further includes an electrical device that either configures the rocker arm assembly or provides position feedback for a part of the rocker arm assembly. According to the present teachings, the valvetrain includes a framework that fits around a spark plug tube while holding a component of a circuit that includes the electrical device in a position adjacent the rocker arm assembly. The position may place the component in contact with or very close to the rocker arm assembly. The framework may fit closely around the spark plug tube. In some of these teachings, the framework abuts the spark plug tube while holding the component in the position adjacent the rocker arm assembly. A framework according to the present teaching may effectively utilize the available space under a valve cover while supporting a component that must be correctly position in relation to the rocker arm assembly in order to function as intended.

The rocker arm may have a range of motion. In some of these teachings, the component is held at a position that is within 5 mm of the rocker arm assembly for at least a portion of that range of motion. In some of these teaching, that distance in less than 2 mm. In some of these teaching, the component is held in abutment with the rocker arm assembly at while the rocker arm is within some portion of its range of motion.

In some of these teachings, the framework rests atop a spark plug tower. A spark plug tower is an upwardly protruding portion of a cylinder head with an opening that receives a spark plug tube. Resting atop the spark plug tower determines a vertical positioning of the framework relative to the cylinder head and further contributes to correct positioning of the component Fitting the framework around the spark plug tube limits motion of the framework relative to the spark plug tube. Interference with the spark plug tube may limit lateral motion of the framework relative to the spark plug tube to 5 mm or less, preferably to 2 mm or less, more preferably to 1 mm or less. In some of these teachings, the framework is shaped to fit tightly around the spark plug tower. In some of these teachings, the framework is shaped to simultaneously locate against a pivot that provides a fulcrum for the rocker arm assembly. Location against the pivot further contributes to correct positioning. In some of these teaching, the framework has a surface with a radius of curvature matching that of the spark pivot where the framework locates against the pivot. In some of these teachings, the framework abuts the pivot.

In some of these teachings, the framework also supports a conductor that is part of the circuit that includes the electrical device. In some of these teachings, the conductor carries current from a location proximate the spark plug tower to a location proximate the rocker arm assembly. In some of these teachings, the conductor is a ribbon of metal. In some of these teaching, the conductor is enclosed within the framework along a portion of the conductor's length.

A location for the conductor proximate the spark plug tube may facilitate connection to a vehicle's power system. In some of these teachings, a connector for coupling the electrical device with a vehicle's power system is attached to the framework at a position proximate where the framework fits around a spark plug tube. In some of these teachings, when the valvetrain is installed in an internal combustion engine having a cylinder head and a valve cover, a circuit that includes the electrical device includes a wire that enters the spark plug tube below the cylinder head and exits the spark plug tube above the cylinder head.

In some of these teachings, the electrical device is an electromagnetic latch assembly comprising an electromagnet operable to cause a latch pin to translate between a first position and a second position. One of the first and second latch pin positions provides a configuration in which the rocker arm assembly is operative to actuate a moveable valve in response to rotation of a cam shaft to produce a first valve lift profile. The other of the first and second latch pin positions provides a configuration in which the rocker arm assembly is operative to actuate the moveable valve in response to rotation of the cam shaft to produce a second valve lift profile, which is distinct from the first valve lift profile, or the poppet valve is deactivated. The latch pin may be mounted to a rocker arm of the rocker arm assembly.

In some of these teachings, the electromagnet is mounted to the rocker arm. In some of these teachings, the component held in the position adjacent the rocker arm assembly by the framework provides electrical power to the electromagnet. In some of these teachings, the electromagnet is powered through an electrical connection formed by abutment between the surfaces of two distinct parts. The rocker arm assembly is operative to move one of the parts independently from the other in response to actuation of the cam follower. The abutting surfaces of the two distinct parts may be electrically isolated from ground. The ground may correspond to a cylinder head of an engine in which the valvetrain is installed. Forming the connection through abutting surfaces that are free to undergo relative motion may reduce or eliminate the need to run wires between parts that undergo relative motion. In some of these teachings, one of the two distinct parts is mounted to the rocker arm assembly and the other is not. One of the two distinct parts that form the electrical connection may be mounted to the rocker arm on which the electromagnet is mounted. The other of the parts may be the component held by the framework in the position adjacent the rocker arm assembly.

In some of these teachings the electromagnetic latch assembly provides the latch pin with positional stability independently from the electromagnet when the latch pin is in the first position and when the latch pin is in the second position. In some of these teachings, the electromagnetic latch assembly is operable with a DC current in a first direction to actuate the latch pin from the first position to the second positions and with a DC current in a second direction, which is a reverse of the first, to actuate the latch pin from the second position to the first position. Having the electromagnetic latch assembly make the latch pin stable without power in both the first and the second positions allows the electrical connection to be broken without the latch pin position changing.

In some of these teachings the electromagnet is mounted to the framework. The latch pin may be mounted to the rocker arm and have a freedom of movement independent from the electromagnet. In these teachings, the electromagnet is operable to cause the latch pin to translate between the first and second positions through magnetic flux that passes between the rocker arm assembly and the component held in the position adjacent the rocker arm assembly by the framework. In some of these teachings, the component held in the position adjacent the rocker arm assembly by the framework is the electromagnet. In some of these teachings, the component held in the position adjacent the rocker arm assembly by the framework is a pole piece for the electromagnet. Spacing between the pole piece and the rocker arm assembly may be critical for the electromagnetic latch assembly to function correctly.

In some of these teachings, the electromagnet that is mounted to the framework is operative to cause the latch pin to translate between the first and second positions through magnetic flux that passes through the rocker arm. An operative portion of the magnetic flux may simply pass through the volume of the rocker arm. In some of these teachings, the magnetic flux flows a magnetic circuit that includes the structure of the rocker arm. All or part of the rocker arm may be formed of magnetically susceptible material. In some of these teachings, the rocker arm is formed primarily or entirely of low coercivity ferromagnetic material. In some of these teachings, the magnetic flux passes through a pole piece fixed to the core structure of the rocker arm. In some of these teachings, the rocker arm includes magnetically susceptible material that if replaced by aluminum would render the electromagnet inoperative to cause the latch pin to translate between the first and second positions. Structuring the latch assembly in this manner enables the latch assembly to have a compact design suitable for packaging within the limited space available under a valve cover.

In some of these teachings, the framework is plastic. In some of these teachings, the conductor that is part of the circuit that includes the electrical device runs through the plastic frame. In some of these teachings, the conductor is a strip of metal enclosed within the plastic frame. The plastic frame may protect the conductor from the surrounding environment, prevent the conductor from contacting moving parts, and prevent the conductor from being damaged during maintenance.

In some of these teachings, once installed in an engine, the framework rests on a cylinder head. In some of these teachings, the framework is secured to the cylinder head. The framework may maintain the wiring in proximity to the cylinder head, where the wiring is out of the way. In some of these teachings, the framework includes a tower extending from the cylinder head to hold the component of the circuit including the electrical device in contact with or very close to the rocker arm.

In some of these teachings, the framework abuts a pivot that provides a fulcrum for a rocker arm assembly. In some of these teachings, the pivot is a lash adjuster. The lash adjuster may be a hydraulic lash adjuster. In some of these teachings, the location of the framework is secured by both the pivot and a spark plug tube. The framework may be braced between the pivot and the spark plug tube.

The primary purpose of this summary has been to present broad aspects of the present teachings in a simplified form to facilitate understanding of the present disclosure. This summary is not a comprehensive description of every aspect of the present teachings. Other aspects of the present teachings will be conveyed to one of ordinary skill in the art by the following detailed description together with the drawings.

DETAILED DESCRIPTION

Figure 1:
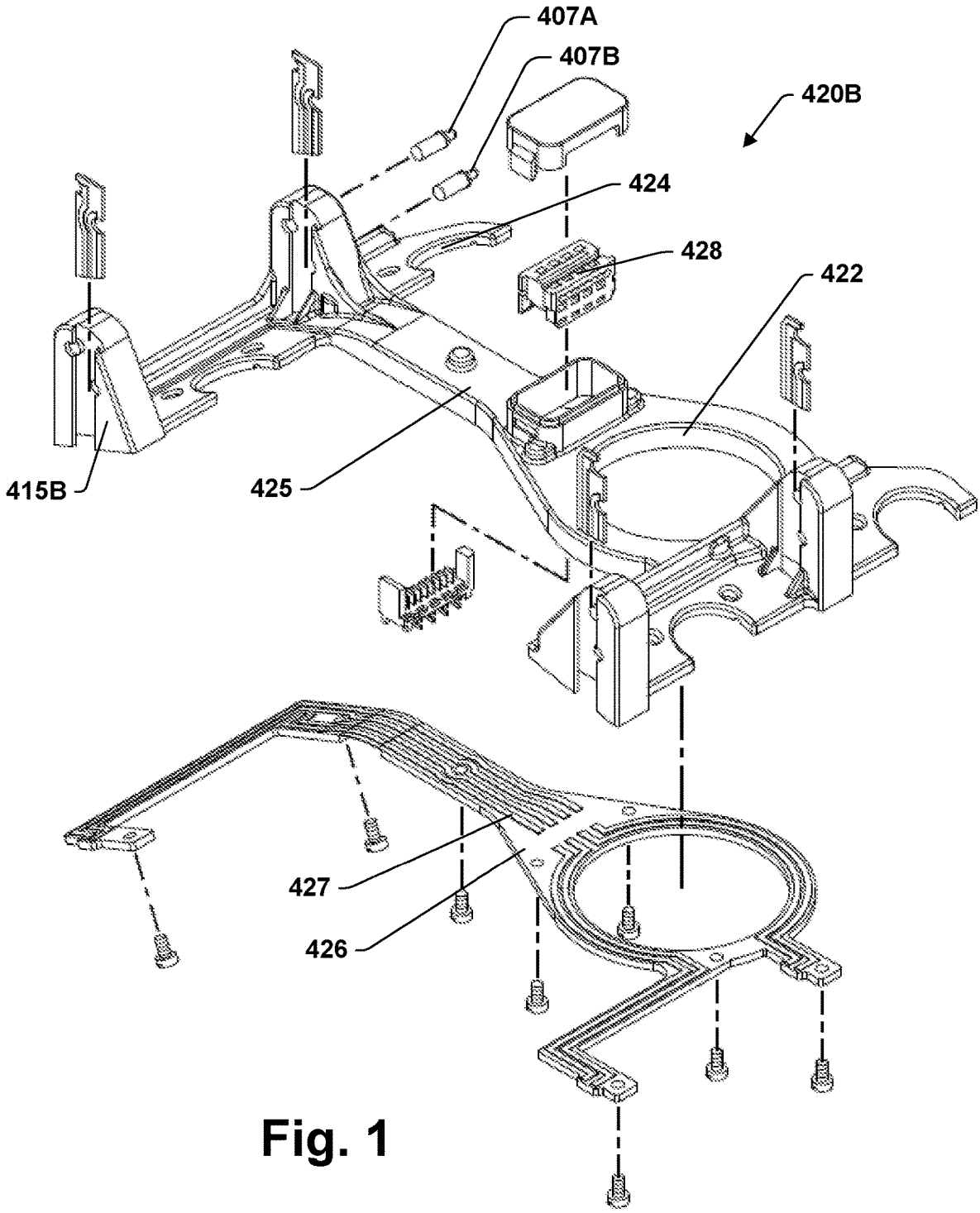
FIG. 1 is an exploded view of a framework according to some aspects of the present teachings.

In the drawings, some reference characters consist of a number with a letter suffix. In this description and the claims that follow, a reference character consisting of that same number without a letter suffix is equivalent to a listing of all reference characters used in the drawings and consisting of that same number with a letter suffix. For example, "rocker arm 103" is the same as "rocker arm 103A, 103B".

FIG. 1 illustrates a framework 420B in accordance with some aspects of the present teachings. Framework 420B may be made of plastic. Framework 420B includes an opening 422 that fits around a spark plug tube (not shown) when framework 420B is installed on a cylinder head 154. Opening 422 allows framework 420B to fit around a spark plug tower. When framework 420B is installed on the cylinder head for which it is designed along with a matching spark plug tube, it's clearance around the spark plug tube is 1 mm or less.

Figure 2:
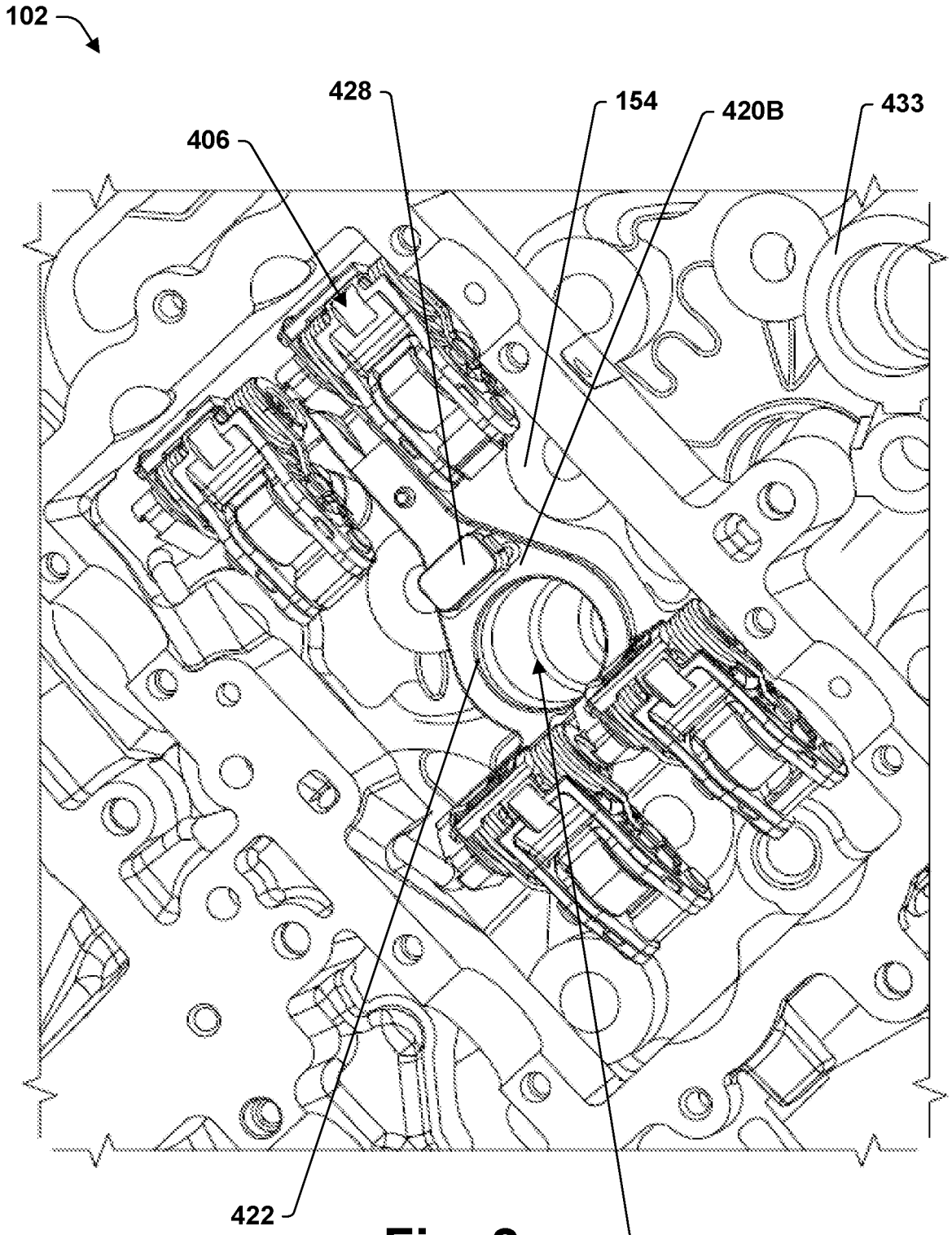
FIG. 2 is a perspective view of a partially manufacture engine in which portions of a valvetrain including the framework of FIG. 1 have been installed.

FIG. 2. shows framework 420B installed on cylinder head 154 of an engine 120. Framework 422 rests on a spark plug tower 433 with opening 422 positioned above and in alignment with opening 429 that is formed spark plug tower 433 to receive a spark plug tube. The spark plug tube may be installed before or after framework 420B. Framework 420B may also include four semi-circular cutouts 424 that fit against pivots 140. (See FIG. 5). When engine 102 is assembled with framework 420B, a spark plug tube fits through opening 422 and cutouts 424 abut pivots 140. The position of framework 420B is thereby constrained. Framework 420B may be secured by fastening framework 420B to cylinder head 154.

As shown in FIG. 1, framework 420B includes an upper part 425 and a lower part 426 that may be fastened together around conductors 427 to provide a wiring harness in which conductors 427 are isolated from the surrounding environment. Slip ring towers 415B may be attached to frame 420B. Alternatively, frame 420B may include slip ring towers 415B as part of a unitary structure. Slip ring towers 415B support spring loaded pins 407 that make electrical connections between conductors 427 and contact pads 404. (See FIGS. 5, 7, and 8).

Figure 3:
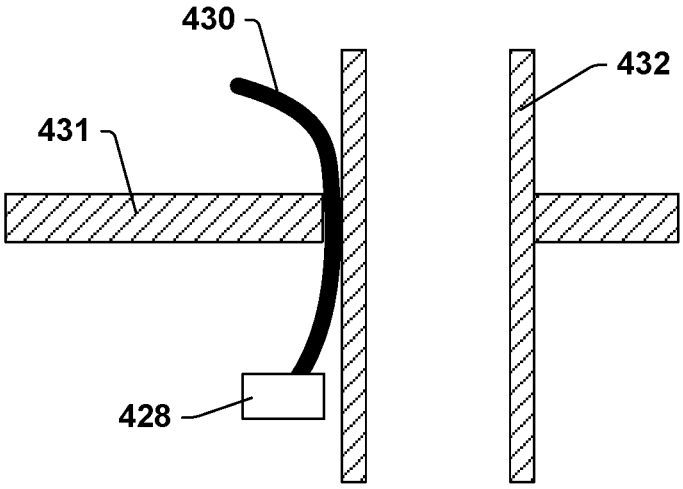
FIG. 3 is a sketch showing wiring through a valve cover in accordance with some aspects of the present teachings.
Figure 4:
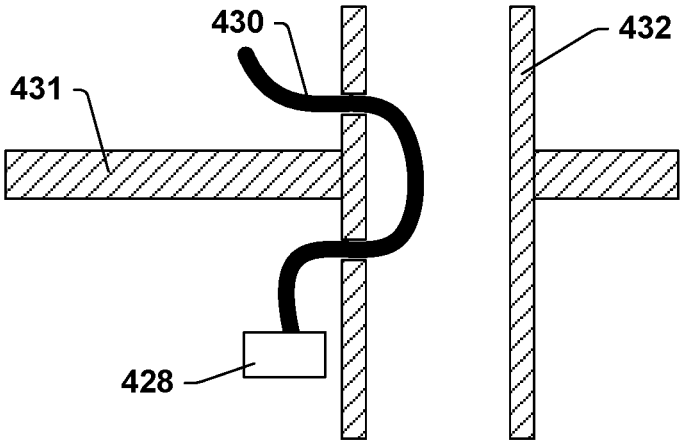
FIG. 4 is a sketch showing wiring through a spark plug tube in accordance with some aspects of the present teachings.

As shown in FIG. 1, frame 420B provides a connection plug 428 adjacent opening 422, which fits around a spark plug tube. Plug 428 is for connecting conductors 427 to a vehicle's power system. As shown in FIG. 3, wires 430 from plug 428 may pass through the valve cover 431 adjacent spark plug tubes 432. Alternatively, as shown in FIG. 4 wires 430 may enter spark plug tube 432 below valve cover 431 and exit spark plug tube 432 above valve cover 431. A valve actuation module may be formed by temporarily securing pivots 140 and rocker arm assemblies 406 to framework 420B. The valve actuation module is easily installed in engine 102.

Figure 5:
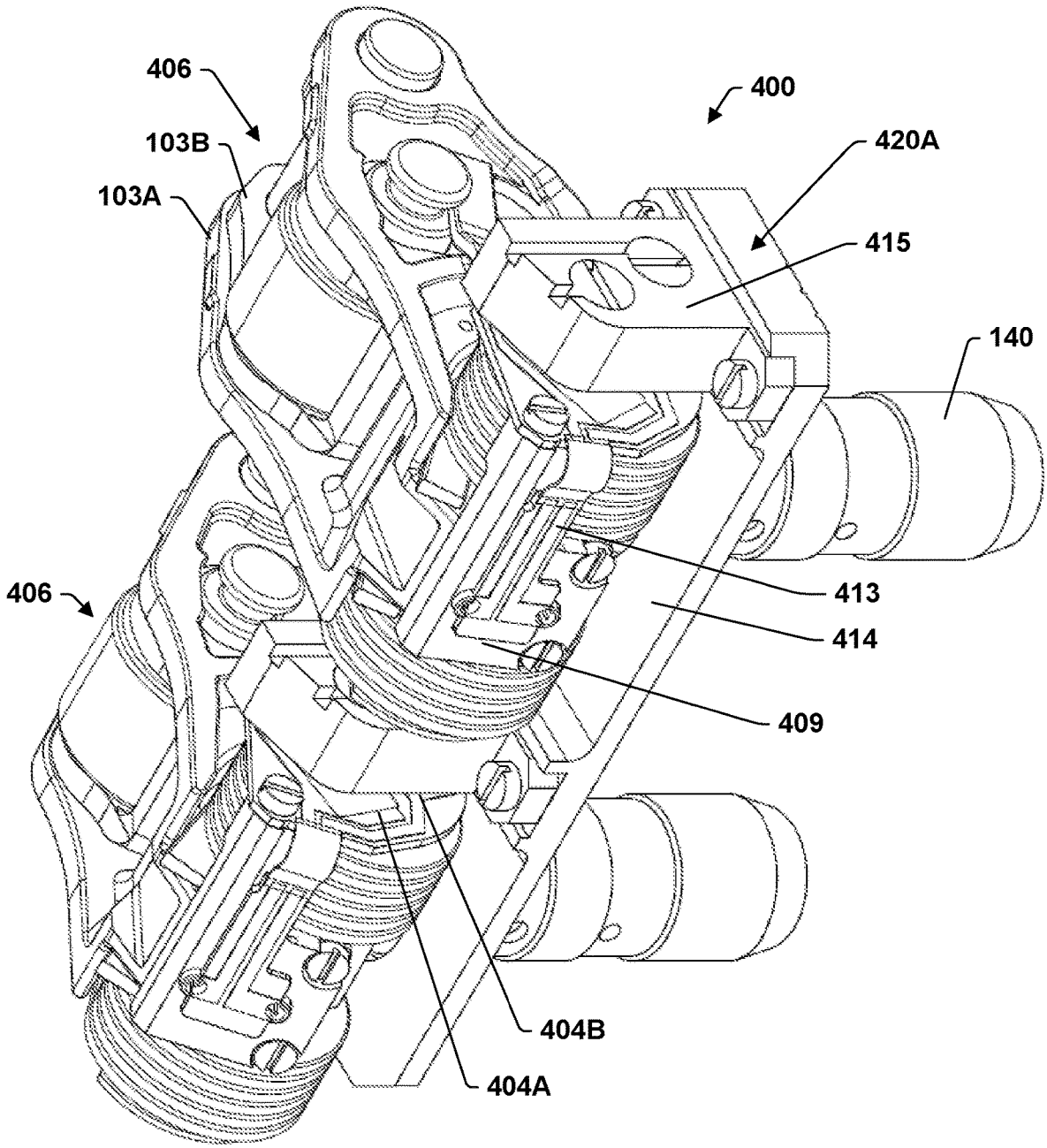
FIG. 5 is a perspective view of a portion of a valvetrain according to some aspects of the present teachings including part of the framework.
Figure 6:
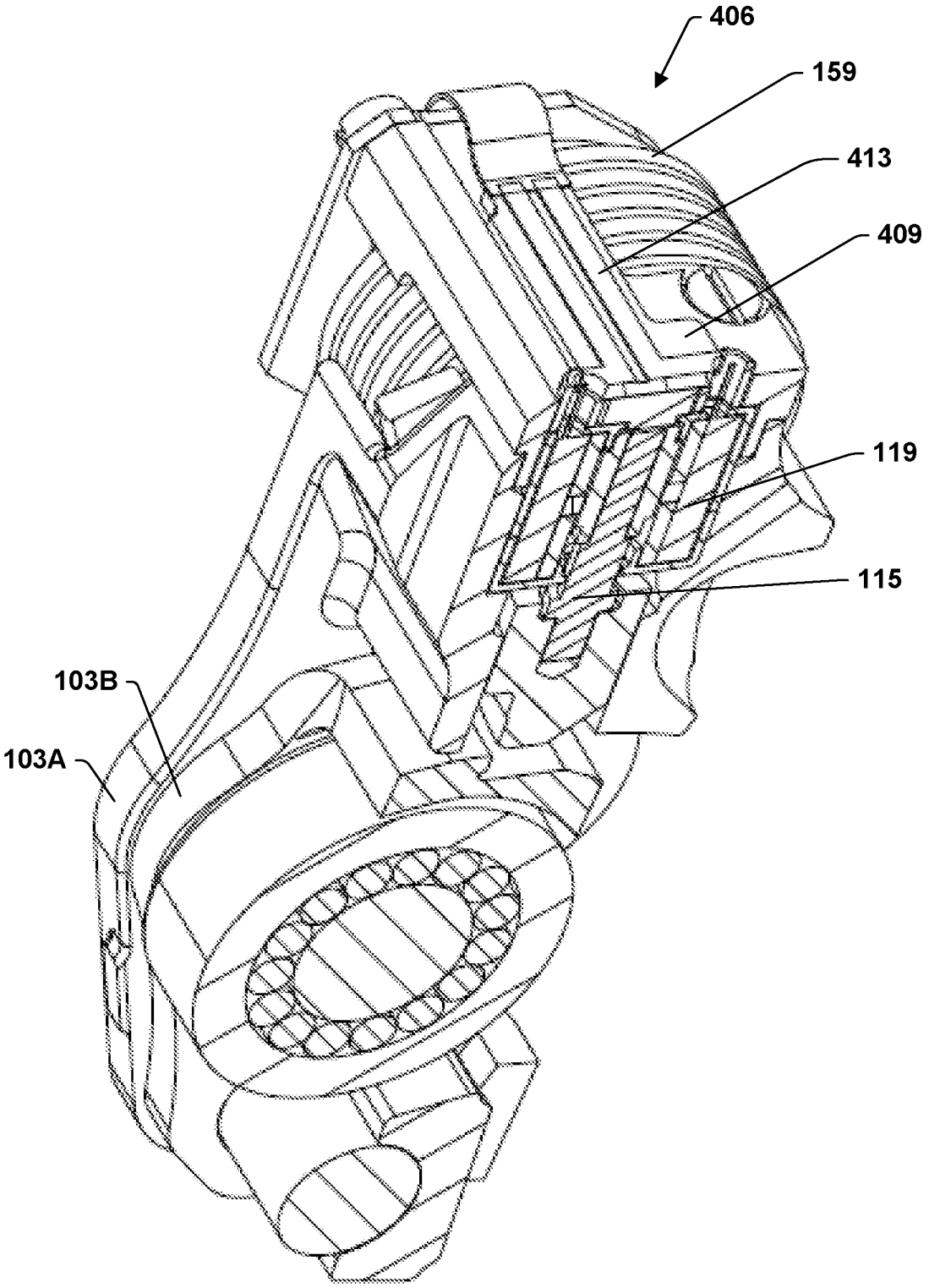
FIG. 6 is a perspective view including a cross-section of one of the rocker arm assemblies of the valvetrain of FIG. 5.
Figure 7:
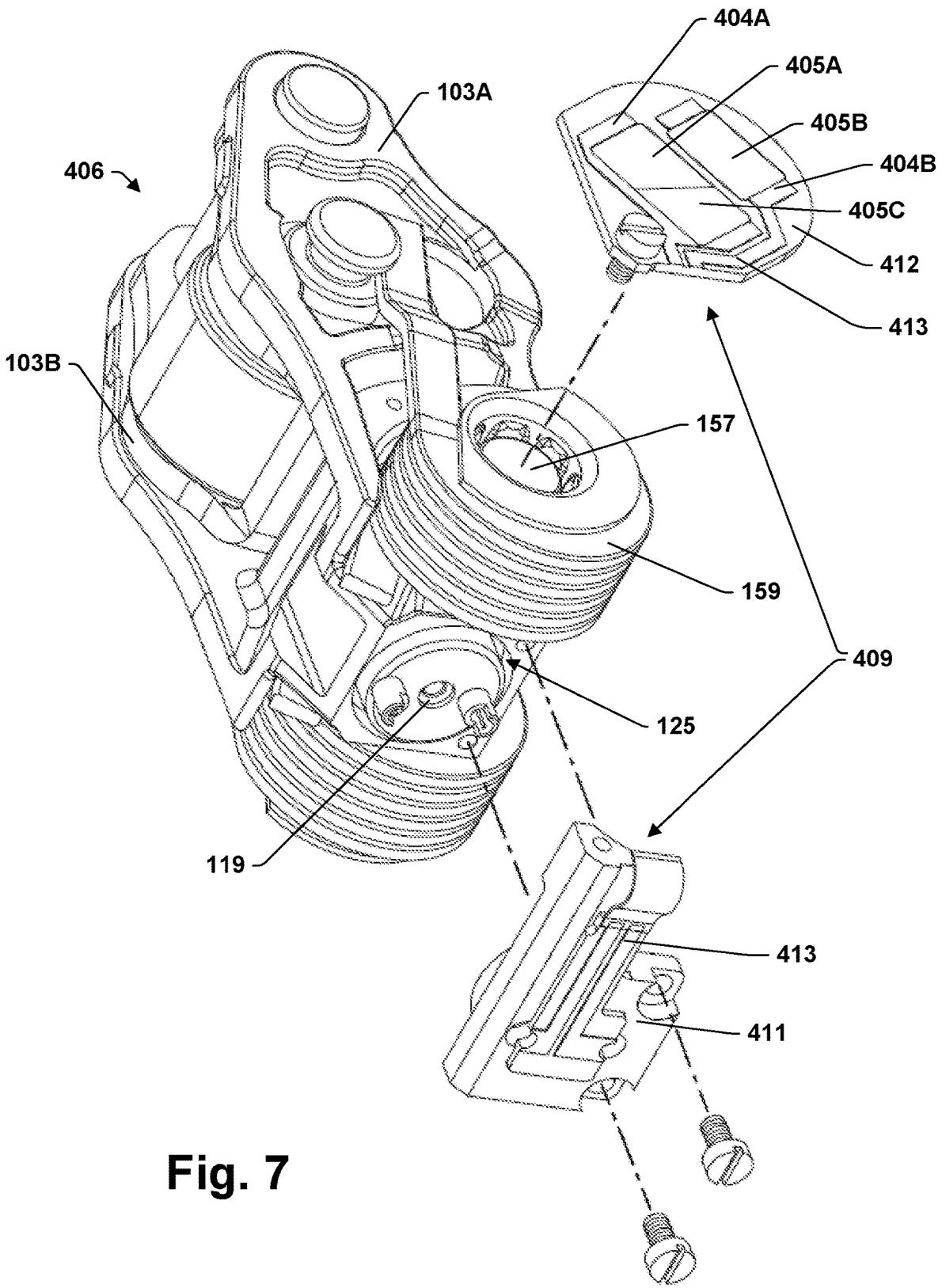
FIG. 7 is a partially exploded view illustrating the way in which contact pads are mounted to a rocker arm assembly of FIG. 5.

FIG. 5-8 illustrates parts of a valvetrain 400 suitable for engine 102. As shown in FIG. 5, valvetrain 400 includes at least two rocker arm assemblies 406. With further reference to FIGS. 6 and 7, rocker arm assemblies 406 include an outer arm 103A, an inner arm 103B, and contact pads 404A and 404B held to one side of outer arm 103A over spring post 157.

Figure 8:
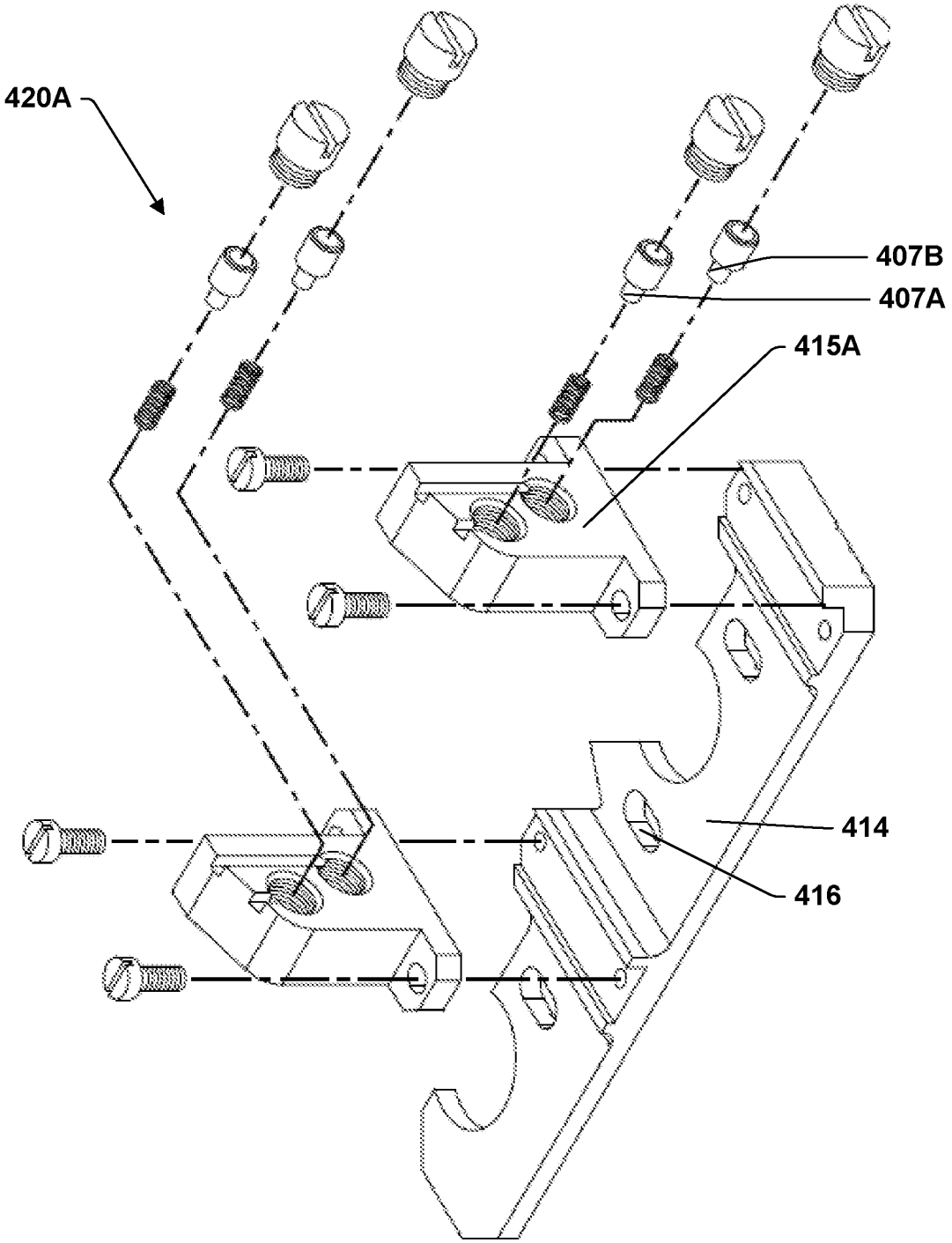
FIG. 8 is an exploded view of a mounting structure for spring loaded contact pins which may be incorporated into the framework of FIG. 1.

Valvetrain 400 includes a framework 420A that holds spring loaded pins 407A and 407B against contact pads 404A and 404B respectively, at least when rocker arm 103A is on base circle. Framework 420B may be modified to incorporate framework 420A. As shown in FIG. 8, framework 420A includes a base plate 414 and slip ring towers 415A that hold spring loaded pins 407 in abutment with contact pads 404. The abutment completes a circuit that provides power to electromagnet 119, which is operative to actuate latch pin 115. Contacts pads 404, electromagnet 119, and latch pin 115 are all mounted to outer arm 103A. Wires 413 couple electromagnet 119 to contact pads 404.

With reference to FIG. 7, contact pads 404A and 404B have planar contact surfaces 405A and 405B respectively. Each rocker arm assembly 406 pivots on a pivot 140. Outer arm 103A and inner arm 103B are free to pivot relative to one-another except when they are engaged by latch pin 115. Pivot 140 may raise or lower rocker arm assembly 406 to adjust lash. These motions take rocker arm 103A in directions parallel to the plane in which the planar contact surfaces contact pads 404A and 404B are oriented. Accordingly, the connections between contacts pads 404 and spring-loaded pins 407 may be maintained as outer arm 103A goes through its range of motion.

In some of these teachings, spring loaded pin 407B remains in abutment with contact surface 405B throughout rocker arm 103A's range of motion. In some of these teachings, spring loaded pin 407A remains in abutment with contact surface 405A through only a portion of rocker arm 103A's range of motion. Contact pad 404A may be structured and positioned such that as rocker arm 103A is lifted off base circle, spring loaded pin 407A moved from abutment with contact surface 405A to abutment with contact surface 405C. Connection through contact surface 405C may present a distinctly higher resistance than connection through contact surface 405A. The higher resistance may be provided by a coating on contact surface 405C that is not present on contact surface 405A. In some of these teachings, that coating is a diamond-like carbon (DLC) coating. The difference in resistance may be used to detect the position of rocker arm 103A.

Latch pin 115 may be installed in rocker arm 103A through opening 408 at the back of rocker arms 103A. Electromagnet 119 is also installed in rocker arm 103A through opening 408. Wires 413, which couple electromagnet 119 to contact pads 404, run out of rocker arm 103A through opening 408. Wires 413 continue around the side of rocker arm 103A to connect with contact pads 404. In some of these teachings, wires 413 and contact pads 404 are supported by a bracket 409 that mount to rocker arm 103A through openings 408.

As shown in FIG. 7, bracket 409 may include a part 411 held at the back of rocker arm 103A and a part 412 held to the side of rocker arm 103A. However, parts 411 and 412 may be provided as a single part. That single part may be formed by over-molding wires 413 and contact pads 404. Bracket 409 may be press fit into opening 408.

As shown in FIG. 8, base plate 414 may include cutouts 424 that have radii of curvature matching those of pivots 140. When framework 420 is installed in engine 102, baseplate 414 may rest atop cylinder head 154 and abut two pivots 140. Cutouts 424 may locate against pivots 140 to ensure proper positioning of framework 420 with respect to rocker arm assemblies 406 and therefore proper position of spring loaded pins 407 with respect to contact pads 404. Framework 420 may be secured to cylinder head 154 by bolts passing through openings 416.

FIGS. 9-12 illustrate an internal combustion engine 102 including a valvetrain 104. The features of valvetrain 104 may be incorporated into valvetrain 400. Valvetrain 104 includes a rocker arm assembly 106, a poppet valve 152, a cam shaft 109 on which is mounted a cam 107, and a pivot 140, which may be a hydraulic lash adjuster. Rocker arm assembly 106 includes an outer arm 103A, an inner arm 103B, and an electromagnetic latch assembly 122. Electromagnetic latch assembly 122 includes electromagnet 119 and latch pin 115. Outer arm 103A and inner arm 103B are selectively engaged by latch pin 115. Pivot 140, which is a hydraulic lash adjuster, sits within a bore 138 formed in cylinder head 154 and provides a fulcrum for rocker arm assembly 106. Poppet valve 152 has a seat 156 within cylinder head 154.

Rocker arm assembly 106 may be held in place by contact with hydraulic lash adjuster 140, cam 107, and poppet valve 152. Cam follower 111 is configured to engage and follow cam 107 as camshaft 109 rotates. Cam follower 111 may be rotatably mounted to inner arm 103B through bearings 114 and axle 112. Rocker arm assembly 106 may include cam followers mounted to both inner arm 103B and outer arm 103A. Cam follower 111 is a roller follower. Another type of cam follower, such as a slider, may be used instead.

Outer arm 103A may be pivotally coupled to inner arm 103B through an axle 155. Axle 155 may also support an elephant's foot 101 through which rocker arm assembly 106 acts on valve 152. Axle 155 may be mounted on bearings or may be rigidly coupled to one of inner arm 103B, outer arm 103A, and elephant's foot 101. Torsion springs (not shown) may be mounted to outer arm 103A on spring posts 157. The torsion springs may act upwardly on axle 112 to create torque between inner arm 103B and outer arm 103A about axle 155 and bias cam follower 111 against cam 107. Openings 124 may be formed in outer arm 103A to allow axle 112 to pass through it and move freely up and down.

Figure 9:
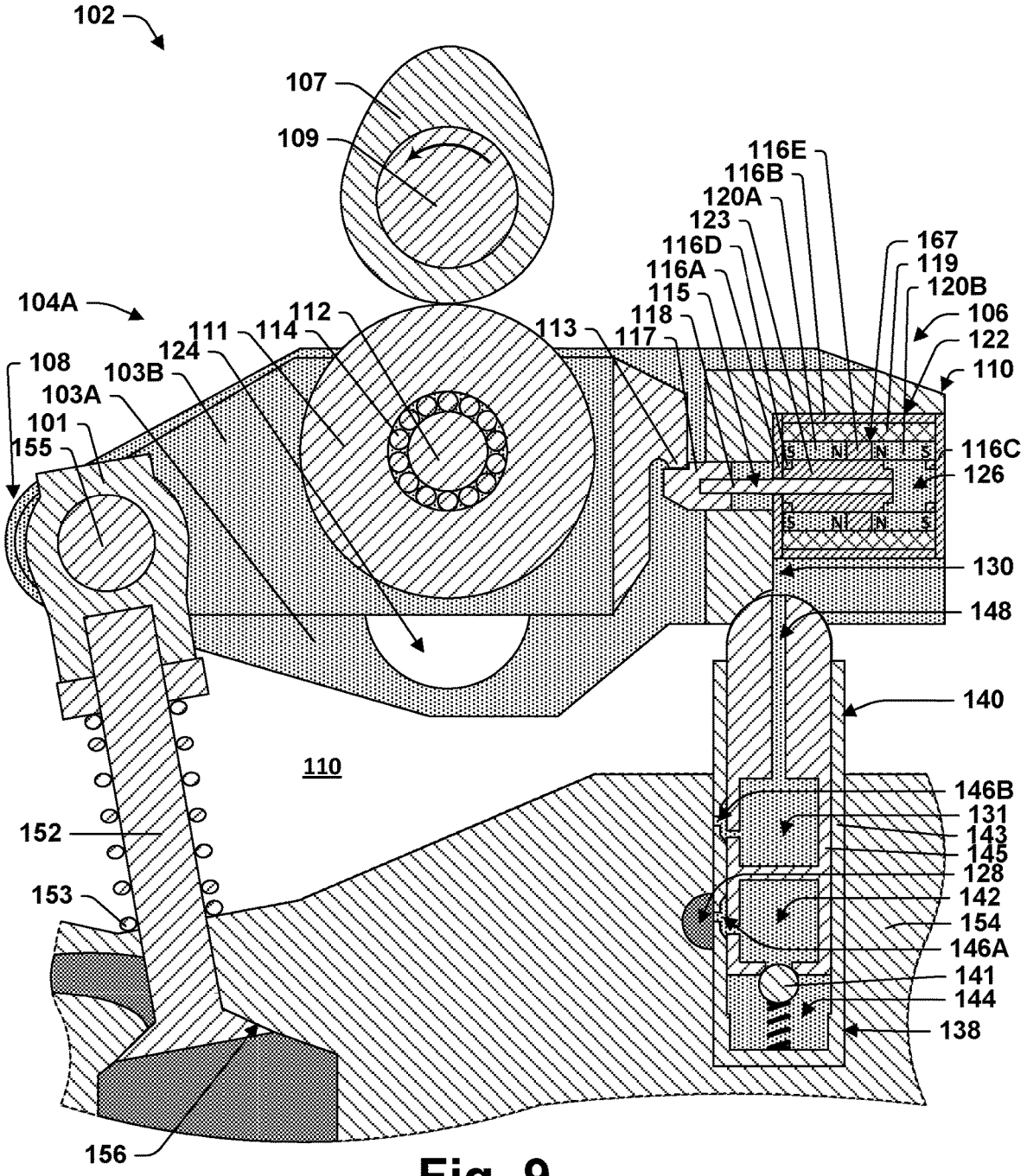
FIG. 9 is a cross-sectional side view of a portion of an internal combustion with a valvetrain including a rocker arm assembly in a latching configuration and a cam on base circle.
Figure 10:
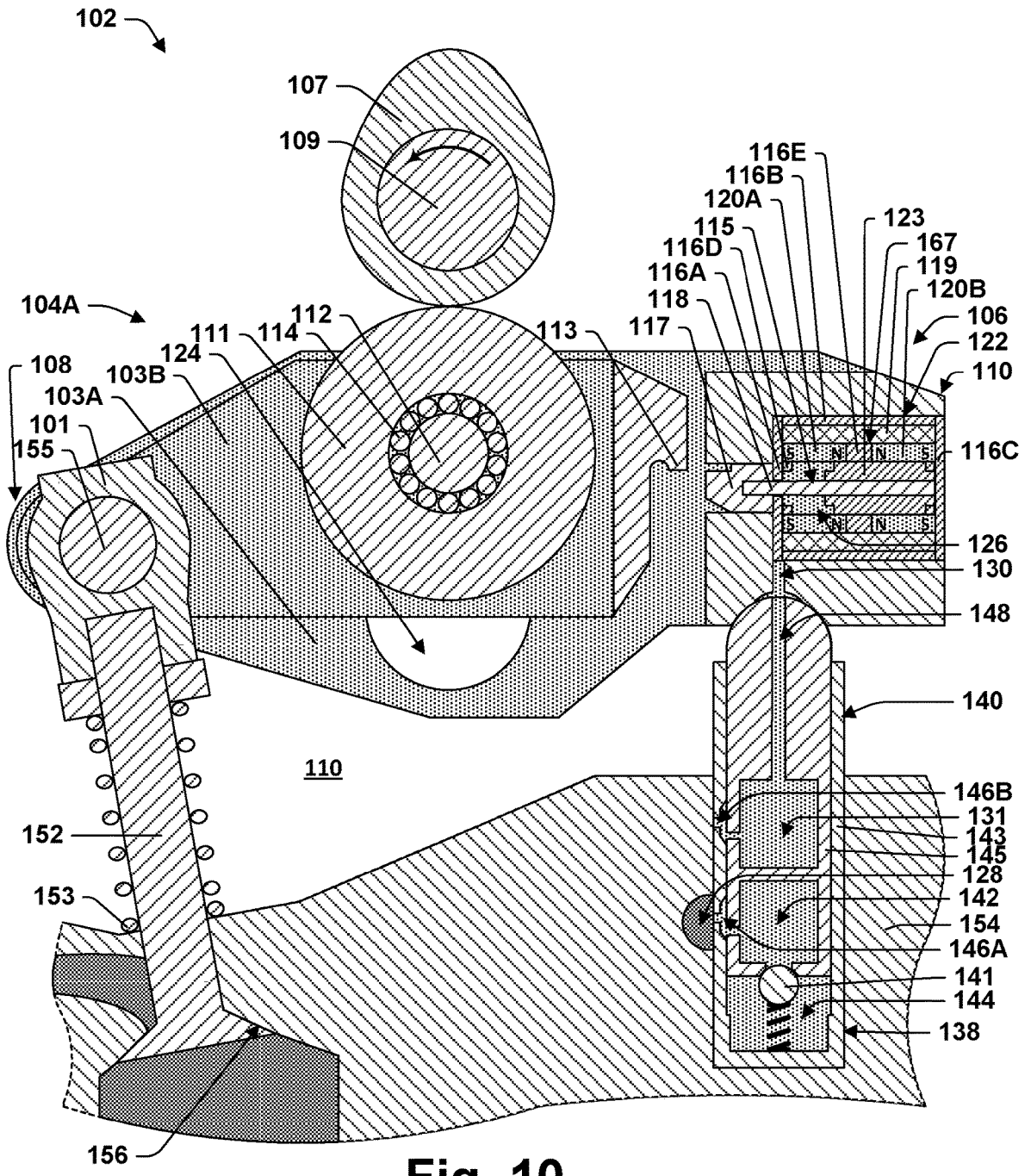
FIG. 10 provides the view of FIG. 9 but with the rocker arm assembly in a latching configuration.

FIG. 9 illustrates internal combustion engine 102 with cam 107 on base circle and latch pin 115 extended. This may be described an engaging position for latch pin 115 or an engaging configuration for rocker arm assembly 106. FIG. 10 shows the result if cam 107 is rotated off base circle while latch pin 115 is in the engaging position. Initially head 117 of latch pin 115 engages lip 113 of inner arm 103B. The force of cam 107 on cam follower 111 may then cause both inner arm 103B and outer arm 103A to pivot together on hydraulic lash adjuster 140, bearing down on valve 152 and compressing valve spring 153. Valve 152 may be lifted off its seat 156 with a valve lift profile determined by the shape of cam 107. The valve lift profile is the shape of a plot showing the height by which valve 152 is lifted of its seat 156 as a function of angular position of cam shaft 109. In the engaging configuration, cam shaft 109 may do work on rocker arm assembly 106 as cam 107 rises off base circle. Much of the resulting energy may be taken up by valve spring 153 and returned to cam shaft 109 as cam 107 descend back toward base circle.

Figure 11:
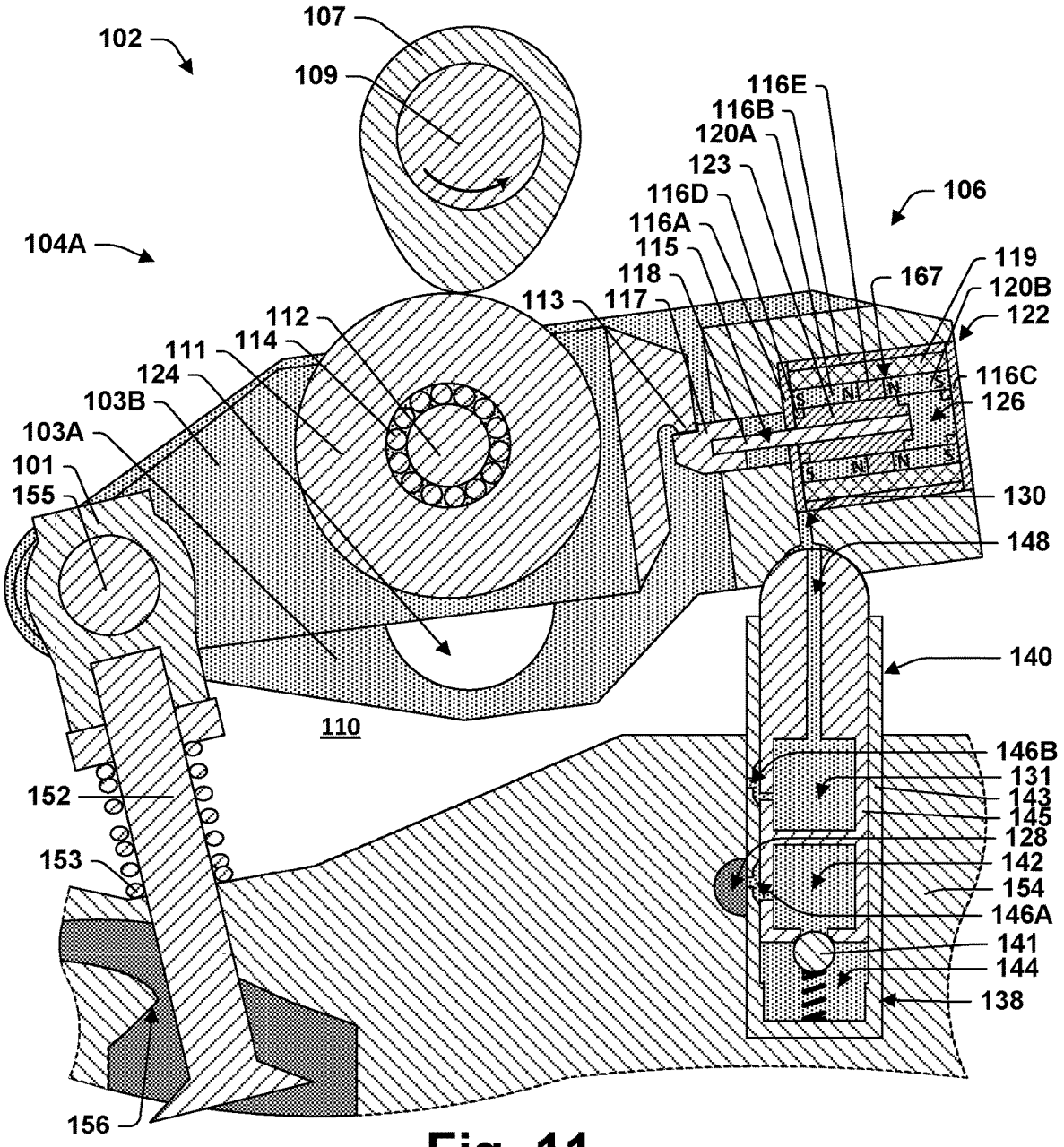
FIG. 11 provides the view of FIG. 9 but with the cam risen off base circle.
Figure 12:
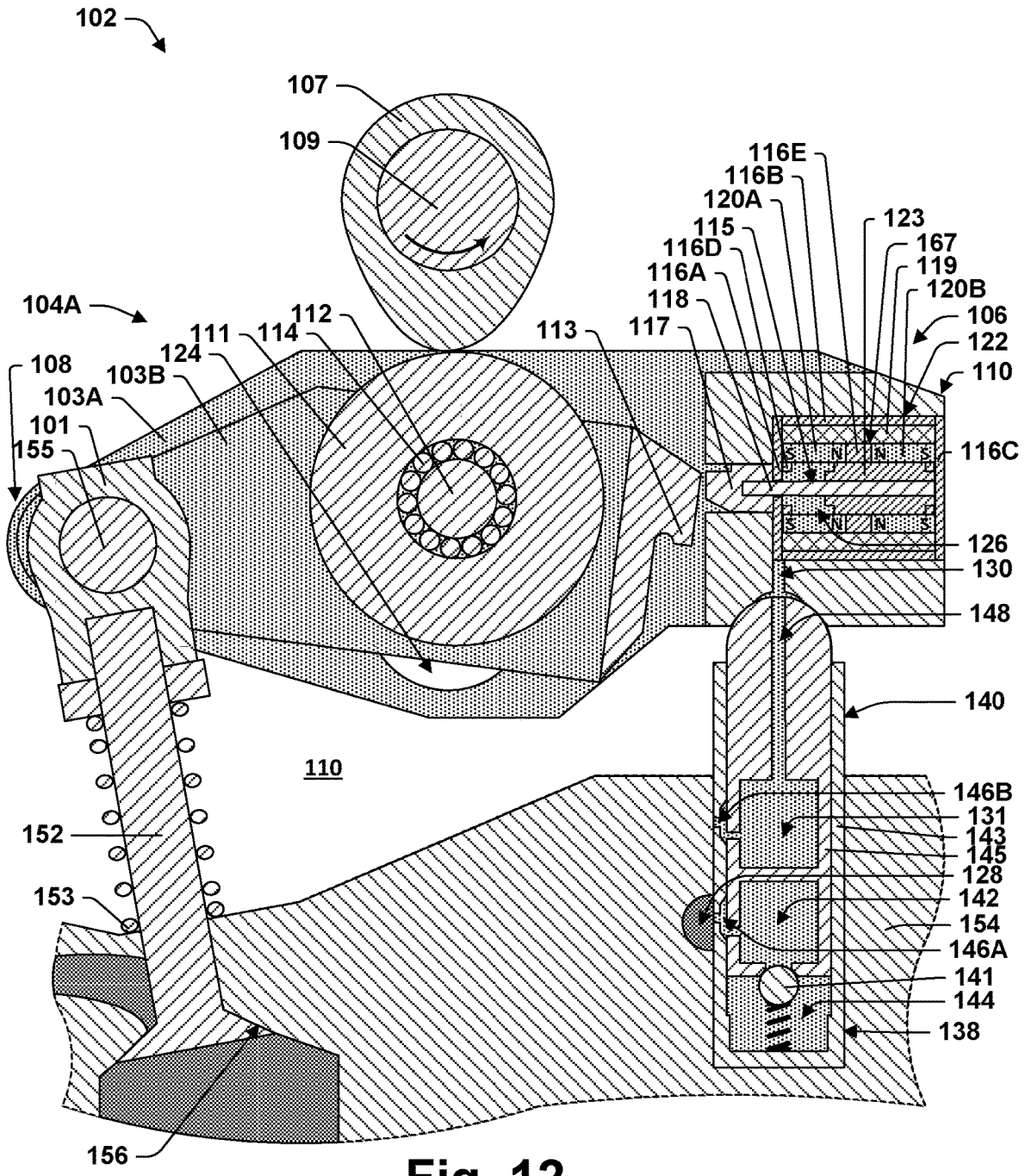
FIG. 12 provides the view of FIG. 10 but with the cam risen off base circle.

Electromagnetic actuator 122 may be operated to retract latch pin 115. FIG. 11 illustrates internal combustion engine 102 with cam 107 on base circle and latch pin 115 retracted. This may be described a non-engaging position for latch pin 115 or a non-engaging configuration for rocker arm assembly 106. FIG. 12 shows the result if cam 107 is rotated off base circle while latch pin 115 is in the non-engaging position. In this configuration, the downward force on cam follower 111 applied by cam 107 as it rises off base circle may be distributed between valve 152 and the torsion springs. The torsions springs may be tuned relative to valve spring 153 such that the torsion springs yield in the unlatched configuration while valve spring 153 does not. The torsion springs wind and inner arm 103B descends while outer arm 103A remains in place. As a result, valve 152 may remain on its seat 156 even as cam 107 rises off base circle. In this configuration, cam shaft 109 still does work on rocker arm assembly 106 as cam 107 rises of base circle. But in this case, most of the resulting energy is taken up by torsions springs 159, which act as lost motion springs.

Hydraulic lash adjuster 140 may be replaced by a static pivot or another type of lash adjuster. Hydraulic lash adjuster 140 may include an inner sleeve 145 and an outer sleeve 143. Lash adjustment may be implemented using a hydraulic chamber 144 that is configured to vary in volume as hydraulic lash adjuster 140 extends or contracts through relative motion of inner sleeve 145 and outer sleeve 143. A supply port 146A may allow a reservoir chamber 142 to be filled from an oil gallery 128 in cylinder block 154. The fluid may be engine oil, which may be supplied at a pressure of about 2 atm. When cam 107 is on base circle, this pressure may be sufficient to open check valve 141, which admits oil into hydraulic chamber 144. The oil may fill hydraulic chamber 144, extending hydraulic lash adjuster 140 until there is no lash between cam 107 and roller follower 111. As cam 107 rises off base circle, hydraulic lash adjuster 140 may be compressed, pressure in hydraulic chamber 144 may rise, and check valve 141 may consequently close.

Rocker arm assembly 106 may have been originally designed for use with a hydraulically latching rocker arm assembly. Accordingly a second supply port 146B may be formed in hydraulic lash adjuster 140 and communicate with a second reservoir chamber 131 in hydraulic lash adjuster 154. Cylinder head 154 may not include any provision for supplying oil to second supply port 146B. Second reservoir chamber 131 may be isolated from any substantial flow of hydraulic fluid in cylinder head 154. Reservoir chamber 131 and hydraulic passages communicating therewith may be essentially non-functional in engine 102.

Valvetrain 104 is an end pivot overhead cam (OHC) type valvetrain. The present teaching are applicable to other types of valvetrains including, for example, an overhead valve (OHV) valvetrains, which may include a rocker arm assembly that is latched. As used in the present disclosure, the term "rocker arm assembly" may refer to any assembly of components that is structured and positioned to actuate valve 152 in response to rotation of a cam shaft 109. Rocker arm assembly 106 is a cylinder deactivating rocker arm. But some of the present teaching are also applicable to switching rocker arms and other types of rocker arm assemblies. In some of these teachings, a rocker arm is a unitary metal piece. Alternatively, a rocker arm may include multiple parts that are rigidly joined.

Components of electromagnetic latch assembly 122 may be mounted within a chamber 126 formed in rocker arm 103A of rocker arm assembly 106. Electromagnetic latch assembly 122 includes electromagnet 119, permanent magnets 120A, and permanent magnet 120B, each of which is rigidly mounted to rocker arm 103A. These parts may be rigidly mounted to rocker arm 103A by being rigidly mounted to other parts that are themselves rigidly mounted to rocker arm 103A. Electromagnetic latch assembly 122 further include latch pin 115 and low coercivity ferromagnetic pieces 116A, 116B, 116C, 116D, and 116E.

Latch pin 115 includes latch pin body 118, latch head 117, and a low coercivity ferromagnetic portion 123. Low coercivity ferromagnetic portion 123 may be part of latch pin body 118 or may be a separate component such as an annular structure fitting around latch pin body 118. Lath pin body 118 may be paramagnetic. Low coercivity ferromagnetic portion 123 provides a low reluctance pathway for magnetic circuits passing through latch pin 115 and may facilitate the application of magnetic forces to latch pin 115.

Low coercivity ferromagnetic pieces 116 may be described as pole pieces in that they are operative within electromagnetic latch assembly 122 to guide magnetic flux from the poles of permanent magnets 120. Low coercivity ferromagnetic pieces 116A, 116B, and 116C are located outside electromagnet 119 and may form a shell around it. Low coercivity ferromagnetic pieces 116D may provide stepped edges in magnetic circuits formed by electromagnetic latch assembly 122. Low coercivity ferromagnetic portion 123 of latch pin 115 may be shaped to mate with these edges. During actuation, magnetic flux may cross an air gap between one of these stepped edge and latch pin 115, in which case the stepped edge may be operative to increase the magnetic forces through which latch pin 115 is actuated.

Electromagnet 119 comprises a large number of wire loops that wrap around a volume 167. In some of these teachings, permanent magnets 120 are positioned within volume 167. Permanent magnets 120 may be held in fixed positions within volume 167. Low coercivity ferromagnetic pieces 116D and 116E may also be positioned within volume 167. Permanent magnets 120A and permanent magnets 120B may be arranged with confronting polarities. Low coercivity ferromagnetic piece 116E may be positioned between the confronting poles and provides a pole piece for both magnets 120. Permanent magnets 120A and 120B may be located at distal ends of volume 167. In some of these teachings, permanent magnets 120 are annular in shape and polarized in a direction parallel to that in which latch pin 115 translates. This may be along a central axis for electromagnet 119.

Electromagnetic latch assembly 122 may provide both extended and retracted positions in which latch pin 115 is stable. As a consequence, either the latched or unlatched configuration can be reliably maintained without electromagnet 119 being powered. Positional stability refers to the tendency of latch pin 115 to remain in and return to a particular position. Stability is provided by restorative forces that acts against small perturbations of latch pin 115 from a stable position. In electromagnetic latch assembly 122 stabilizing forces are provided by permanent magnets 120. Alternatively or in addition, one or more springs may be positioned to provide positional stability. Springs may also be used to bias latch pin 115 out of a stable position, which may be useful for increasing actuation speed.

Figure 13:
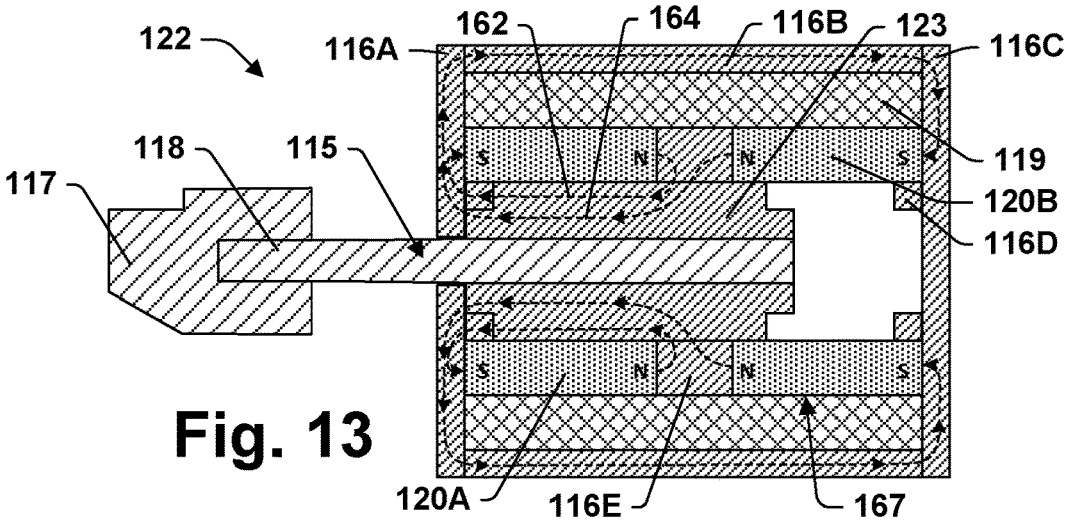
FIG. 13 is a cross-section side view of an electromagnetic latch assembly with the latch pin in an extended position.
Figure 15:
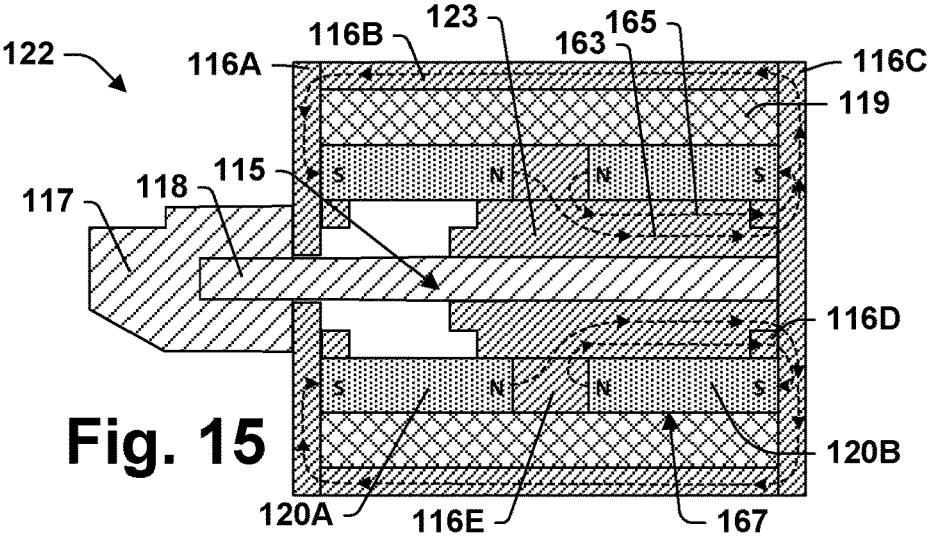
FIG. 15 provides the view of FIG. 13 but with the latch pin in a retracted position.

As shown in FIGS. 13 and 15, in electromagnetic latch assembly 122, permanent magnet 120A stabilizes latch pin 115 in both the extended and the retracted positions. Electromagnetic latch assembly 122 may form two distinct magnetic circuits 162 and 163 to provide this functionality. As shown in FIG. 13, magnetic circuit 162 is the primary path for an operative portion of the magnet flux from permanent magnet 120A when latch pin 115 is in the extended position, absent magnetic fields from electromagnet 119 or any external source that might alter the path taken by flux from permanent magnet 120A.

Magnetic circuit 162 proceeds from the north pole of permanent magnet 120A, through pole piece 116E, through latch pin 115, through pole piece 116D and pole piece 116A and ends at the south pole of permanent magnet 120A. Path 163 is the primary path for an operative portion of the magnet flux from permanent magnet 120A when latch pin 115 is in the extend position. A magnetic circuit is a primary path if it is a path taken by the majority of the flux. Perturbation of latch pin 115 from the extended position would introduce an air gap into magnetic circuit 162, increasing its magnetic reluctance. Therefore, the magnetic forces produced by permanent magnet 120A resist such perturbations.

As shown in FIG. 15, magnetic circuit 163 is the primary path for an operative portion of the magnet flux from permanent magnet 120A when latch pin 115 is in the retracted position, absent magnetic fields from electromagnet 119 or any external source that might alter the path taken by flux from permanent magnet 120A. Magnetic circuit 163 proceeds from the north pole of permanent magnet 120A, through pole piece 116E, through latch pin 115, through a pole piece 116D, through pole pieces 116C, 116B, and 116A, and ends at the south pole of permanent magnet 120A. Path 163 is the primary path for an operative portion of the magnet flux from permanent magnet 120A when latch pin 115 is in the retracted position. Perturbations of latch pin 115 from the retracted position would introduce an air gap into magnetic circuit 162, increasing its magnetic reluctance. Therefore, the magnetic forces produced by permanent magnet 120A resist such perturbations.

Electromagnetic latch assembly 122 may also include a second permanent magnet 120B that is also operative to stabilize latch pin 115 in both the extended and the retracted positions. Electromagnetic latch assembly 122 forms two distinct magnetic circuits 164 and 165 for magnetic flux from second permanent magnet 120B. Magnetic circuit 164 is the primary path for an operative portion of the magnet flux from permanent magnet 120B when latch pin 115 is in the extended position and magnetic circuit 165 is the primary path for an operative portion of the magnet flux from permanent magnet 120B when latch pin 115 is in the retracted position. Like magnetic circuit 162, magnetic circuit 165 goes around the outside of electromagnet 119. Like magnetic circuit 163, magnetic circuit 164 does not.

Figure 14:
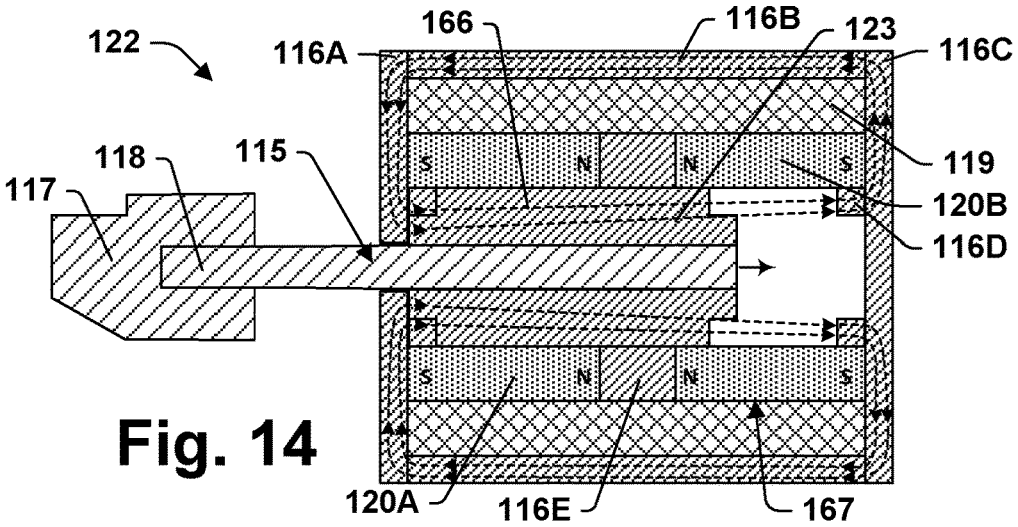
FIG. 14 provides the same view as FIG. 13, but illustrating magnetic flux that may be generated by the electromagnet.

Electromagnetic latch assembly 122 is structured to operate through a magnetic flux shifting mechanism. Electromagnetic latch assembly 122 is operative to actuate latch pin 115 between the extended and retracted positions by redirecting flux from permanent magnets 120. FIG. 14 illustrates the mechanism for this action in the case of operating electromagnet 119 to induce latch pin 115 to actuate from the extended position to the retracted position. A voltage of suitable polarity may be applied to electromagnet 119 to induce magnetic flux following the circuit 166. The magnetic flux from electromagnet 119 reverses the magnetic polarity in low coercivity ferromagnetic elements forming the magnetic circuits 162 and 164 through which permanent magnets 120 stabilized latch pin 115 in the extended position. This greatly increase the reluctance of magnetic circuits 162 and 164. Magnetic flux from permanent magnets 120 may shift from magnetic circuits 162 and 164 toward magnetic circuits 163 and 165. The net magnetic forces on latch pin 115 may drive it to the retracted position shown in FIG. 15. In accordance with some aspects of the present teachings, the total air gap in the magnetic circuit 161 taken by flux from electromagnet 119 does not vary as latch pin 115 actuates. This feature may relate to operability through a flux shifting mechanism.

One way in which electromagnetic latch assembly 122 may be identified as having a structure that provides for a magnetic flux shifting mechanism is that electromagnet 119 does not need to do work on latch pin 115 throughout its traverse from the extended position to the retracted position or vis-versa. While permanent magnets 220 may initially holds latch pin 115 in a first position, at some point during latch pin 115's progress toward the second position, permanent magnets 220 begins to attract latch pin 115 toward the second position. Accordingly, at some point during latch pin 115's progress, electromagnet 119 may be disconnected from its power source and latch pin 115 will still complete its travel to the second position. And as a further indication that a magnetic flux shifting mechanism is formed by the structure, a corresponding statement may be made in operation of electromagnet 119 to induce actuation from the second position back to the first. Put another way, a permanent magnet 220 that is operative to attract latch pin 115 into the first position is also operative to attract latch pin 115 into the second position.

As used herein, a permanent magnet is a high coercivity ferromagnetic material with residual magnetism. A high coercivity means that the polarity of permanent magnet 120 remains unchanged through hundreds of operations through which electromagnetic latch assembly 122 is operated to switch latch pin 115 between the extended and retracted positions. Examples of high coercivity ferromagnetic materials include compositions of AlNiCo and NdFeB.

Magnetic circuits 162, 163, 164, 165 may be formed by low coercivity ferromagnetic material, such as soft iron. Magnetic circuits 162, 163, 164, 165 may have low magnetic reluctance. In accordance with some aspects of the present teachings, permanent magnets 120 have at least one low reluctance magnetic circuit available to them in each of the extended and retracted positions. These paths may be operative as magnetic keepers, maintaining polarization and extending the operating life of permanent magnets 120.

Low coercivity ferromagnetic pieces 116 may form a shell around electromagnet 119. In some of these teachings, a rocker arm 103 to which electromagnet 119 is mounted is formed of a low coercivity ferromagnetic material, such as a suitable steel, and the rocker arm 103 may be consider as providing these pieces or fulfilling their function.

Magnetic circuits 162 and 165 are short magnetic circuits between the poles of permanent magnets 120A and 120B respectively. Magnetic circuits 162 and 165 pass through low coercivity ferromagnetic portion 123 of latch pin 115 but not around the loops of electromagnet 119. These short magnetic circuits may reduce magnetic flux leakage and allow permanent magnets 120 to provide a high holding force for latch pin 115. Magnetic circuits 163 and 164, on the other hand, pass around the loops of electromagnet 119. Routing these magnetic circuits around the outside of electromagnet 119 may keep them from interfering with the shorter magnetic circuits. These longer, alternate magnetic circuits can allow permanent magnets 120 to contribute to stabilizing latch pin 115 in both extended and retracted positions and can assure there is a low reluctance magnetic circuit to help maintain the polarization of permanent magnets 120 regardless of whether latch pin 115 is in the extended or the retracted position.

In accordance with some aspects of the present teachings, electromagnet 119 is powered by circuitry (not shown) that allows the polarity of a voltage applied to electromagnet 119 to be reversed. A conventional solenoid switch forms a magnetic circuit that include an air gap, a spring that tends to enlarge the air gap, and an armature moveable to reduce the air gap. Moving the armature to reduce the air gap reduces the magnetic reluctance of that circuit. As a consequence, energizing a conventional solenoid switch causes the armature to move in the direction that reduces the air gap regardless of the direction of the current through the solenoid's electromagnet or the polarity of the resulting magnetic field. As described above, however, latch pin 115 of electromagnetic latch assembly 122 may be moved in either one direction or another depending on the polarity of the magnetic field generated by electromagnet 119. Circuitry, an H-bridge for example, that allows the polarity of the applied voltage to be reversed enables the operation of electromagnetic latch assembly 122 for actuating latch pin 115 to either an extended or a retracted position. Alternatively, one voltage source may be provided for extending latch pin 115 and another for retracting latch pin 115. Another alternative is to provide two electromagnets 119, one with windings in a first direction and the other with windings in the opposite direction. One or the other electromagnet 199 may be energized depending on the position in which it is desired to place latch pin 115.

Figure 16:
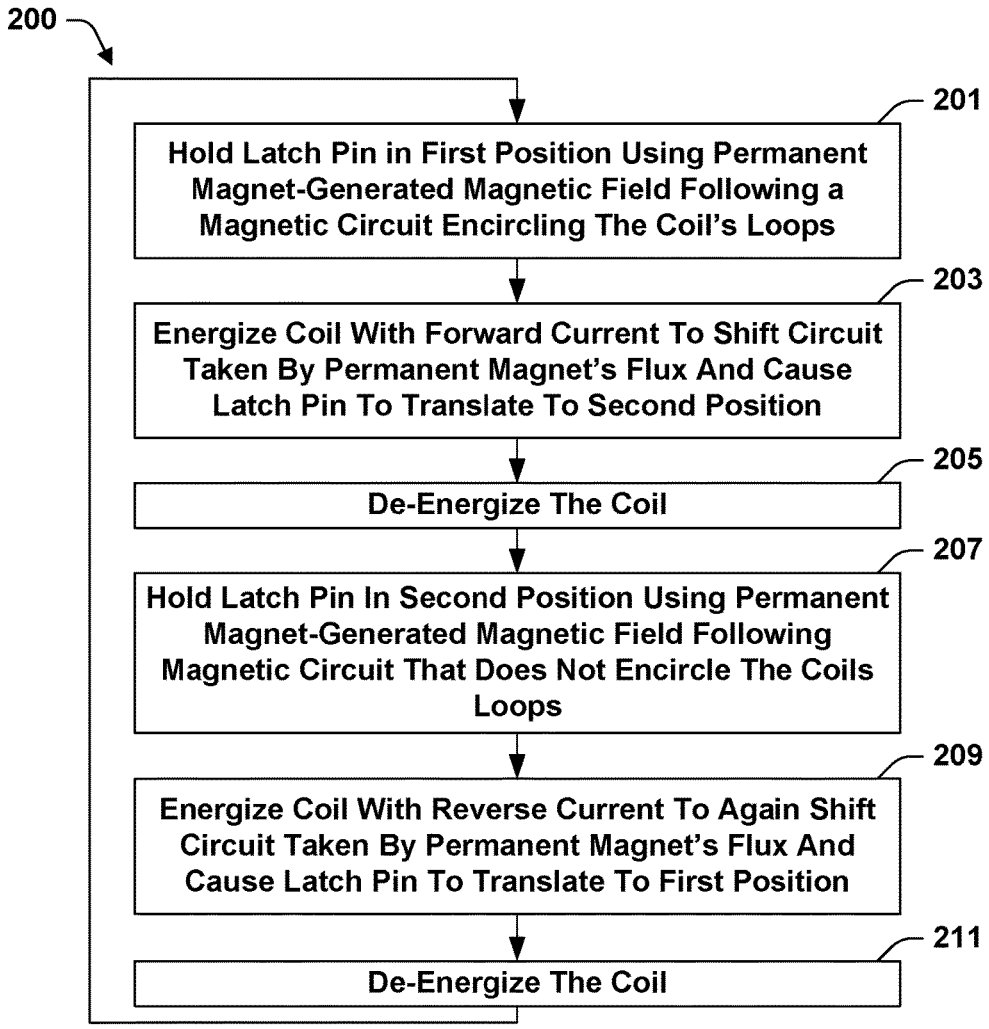
FIG. 16 is a flow chart of a method of operating an internal combustion engine, or a rocker arm assembly thereof.

FIG. 16 provides a flow chart of a method 200 that may be used to operate internal combustion engine 102. Method 200 begins with action 201, holding latch pin 115 in a first position using a magnetic field generated by a first permanent magnet 120A and following a magnetic circuit 163 that encircles the windings of electromagnet 119. Such a magnetic circuit may include a segment passing through electromagnet 119 and a segment that is outside electromagnet 119. The first position may correspond to either an extended or a retracted position for latch pin 115. Action 201 may further include holding latch pin 115 in the first position using a magnetic field generated by a second permanent magnet 120B and following a shorter magnetic circuit 165 that does not encircles the windings of electromagnet 119.

Method 200 continues with action 203, energizing electromagnet 119 with a current in a forward direction to alter the circuit taken by flux from first permanent magnet 120A and cause latch pin 115 to translate to a second position. Energizing electromagnet 119 with a current in a forward direction may also alter the circuit taken by flux from a second permanent magnet 120B. Action 203 may be initiated by an automatic controller. The controller may be an ECU.

Following translation of latch pin 115 to the second position through action 203, electromagnet 119 may be disconnected from its power source with action 205. Method 200 then continues with action 207, holding latch pin 115 in the second position using a magnetic field generated by a first permanent magnet 120A and following a magnetic circuit 162 that does not encircles the windings of electromagnet 119. This may be a short magnetic circuit with low magnetic flux leakage. In some of these teachings, action 207 further includes holding latch pin 115 in the second position using a magnetic field generated by a second permanent magnet 120B and following a magnetic circuit 164 that encircles the windings of electromagnet 119.

Method 200 may continue with action 209, energizing electromagnet 119 with a current in a reverse direction to again alter the circuit taken by flux from first permanent magnet 120A. Action 209 causes latch pin 115 to translate back to the first position. Energizing electromagnet 119 with a current in a reverse direction may also alter the circuit taken by flux from a second permanent magnet 120B. Action 209 also may be initiated by an automatic controller, such as an ECU. Action 211 may then be carried out, which is again de-energizing electromagnet 119. The actions of method 200 may subsequently repeat.

Electromagnetic latch assembly 122 may have dual positional stability and may be operated by the method 200. Alternatively, electromagnetic latch assembly 122 may be a different type of latch such as a conventional solenoid switch that forms a magnetic circuit that include an air gap, has a spring that tends to enlarge the air gap, and has an armature moveable to reduce the air gap. This conventional switch may have only one stable position, one maintained by a spring for example. The stable position may correspond to an extended or a retracted position for latch pin 115. The other position may be maintained by continuously powering electromagnet 119.

Magnetic components of electromagnetic latch assembly 122 may be housed in a chamber 126 formed in rocker arm 103A. The magnetic component housed in chamber 126 are permanent magnets 120A and 120B and electromagnet 119. Chamber 126 may be sealed against intrusion from metal particles that may be in oil dispersed throughout the environment 105 surrounding rocker arm assembly 106. Openings off chamber 126 may be sealed in any suitable manner consistent with the objective. Chamber 126 may be sealed in part by a seal around latch pin 115 at a location where latch pin 115 extends out of chamber 126. Pole piece 116C or another component may seal off an opening through which parts of electromagnetic latch assembly 122 may have been installed in chamber 126.

Chamber 126 may be a hydraulic chamber. Chamber 126 may have been adapted to house parts of electromagnetic latch assembly 122. Rocker arm assembly 106 may be made using rocker arms 103 put into production for use with a hydraulically actuated latch. Electric latch assembly 122 may have been installed in place of a hydraulic latch. While chamber 126 is a hydraulic chamber, it need not be functionally connected to a hydraulic system. A hydraulic passage 130 may connect to chamber 126. Hydraulic passage 130 may be blocked to help seal chamber 126. In some of these teaching, hydraulic passage 130 couples with a hydraulic passage 148 formed in hydraulic lash adjuster 140.

It has been determined that an electromagnet 119 of sufficient power can be fit in chamber 126 of rocker arm 103A. In particular, simulations have shown that electromagnet 119 may have a 7.2 mm outer diameter, a 2.5 mm inner diameter, and a 7.9 mm length. It may have 560 turns of 35 AWG copper wire. It may be powered at 9 VDC with a maximum current of 0.8 A. A peak electromagnetic force of 1.65 N on latch pin 115A may be realized with the aid of a shell 118 having a thickness of 0.5 mm. Latch pin weight can be limited to about 2 g. Frictional resistance may be limited to 0.6 N @ 0° C., with much lower friction expected at higher temperatures. Under these conditions, electromagnet 119 may drive latch pin 115 through a distance of 1.9 mm in 4 ms. Electromagnet 119 may have a diameter of 20 mm or less. Preferably, electromagnet 119 has a diameter of 10 mm or less. These dimensions facilitate fitting electromagnet 119 into a chamber 126 formed in rocker arm 103A.

The displacement required to actuate latch pin 115 from the first the second position may be 5 mm or less, e.g., about 2 mm. Actuating latch pin 115 may be operative to change valve lift timing. Rocker arm assembly 106 may be a cylinder deactivating rocker arm and actuating latch pin 115 activates or deactivates valve 152. In some alternative teachings, rocker arm assembly 106 is a switching rocker arm. A switching rocker arm may be operative to provide VVL. A switching rocker arm may include an inner arm 103B and an outer arm 103A that are selectively engaged by a latch pin 115 and actuating latch pin 115 switches the valve lift timing between a first profile and a second profile.

Figure 17:
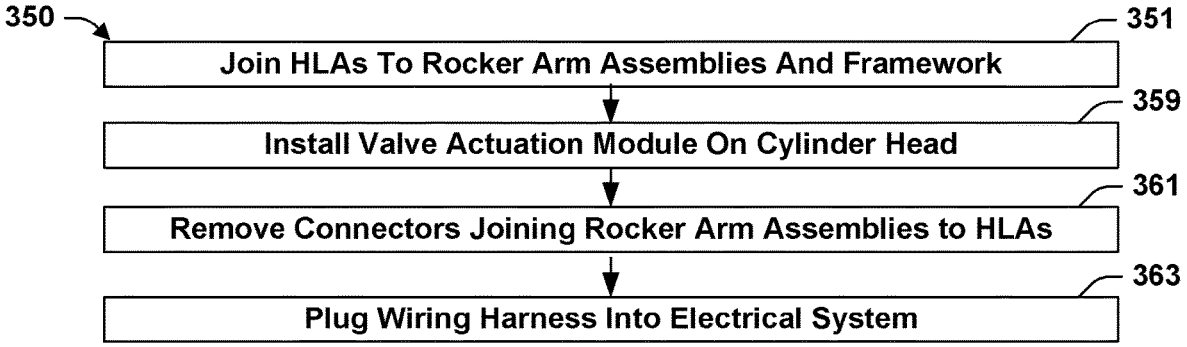
FIG. 17 is a flow chart of a manufacturing method according to some aspects of the present teachings.

FIG. 17 is a flow chart of a method 350 of manufacturing an internal combustion engine 102. Method 350 may begin with action 351, temporarily joining rocker arm assemblies 106 to pivots 140 or framework 420B to form a valve actuation module. These parts may be joined with any type of connector that can hold rocker arm assemblies 106 and pivots 140 together during installation and can be easily removed after installation. In some of these teachings, those connectors are made of plastic or cardboard. Those connectors may be formed of a material unsuited for engine operating conditions. The connectors may be breakaway connectors with weak points formed or designed into their structure. Alternatively, the connectors may be simply removable connectors.

Action 359 is installing the valve actuation module on cylinder head 154. In accordance with the present teachings, this may include installing all the pivots 140 of the valve actuation module simultaneously in openings formed in cylinder head 154 while placing framework 420B on spark plug towers 433 with opening 422 aligned with openings 429. Action 359 may be simply dropping valve actuation module 170 onto cylinder head 154. Action 361 is removing the connectors 171 joining rocker arms 103 to pivots 140 or framework 420B. Action 363 is plugging connection plug 428 into the electrical system (not shown) of internal combustion engine 102. The actions of method 350 may take place in any order consistent with the logic of this method.

Figure 18:
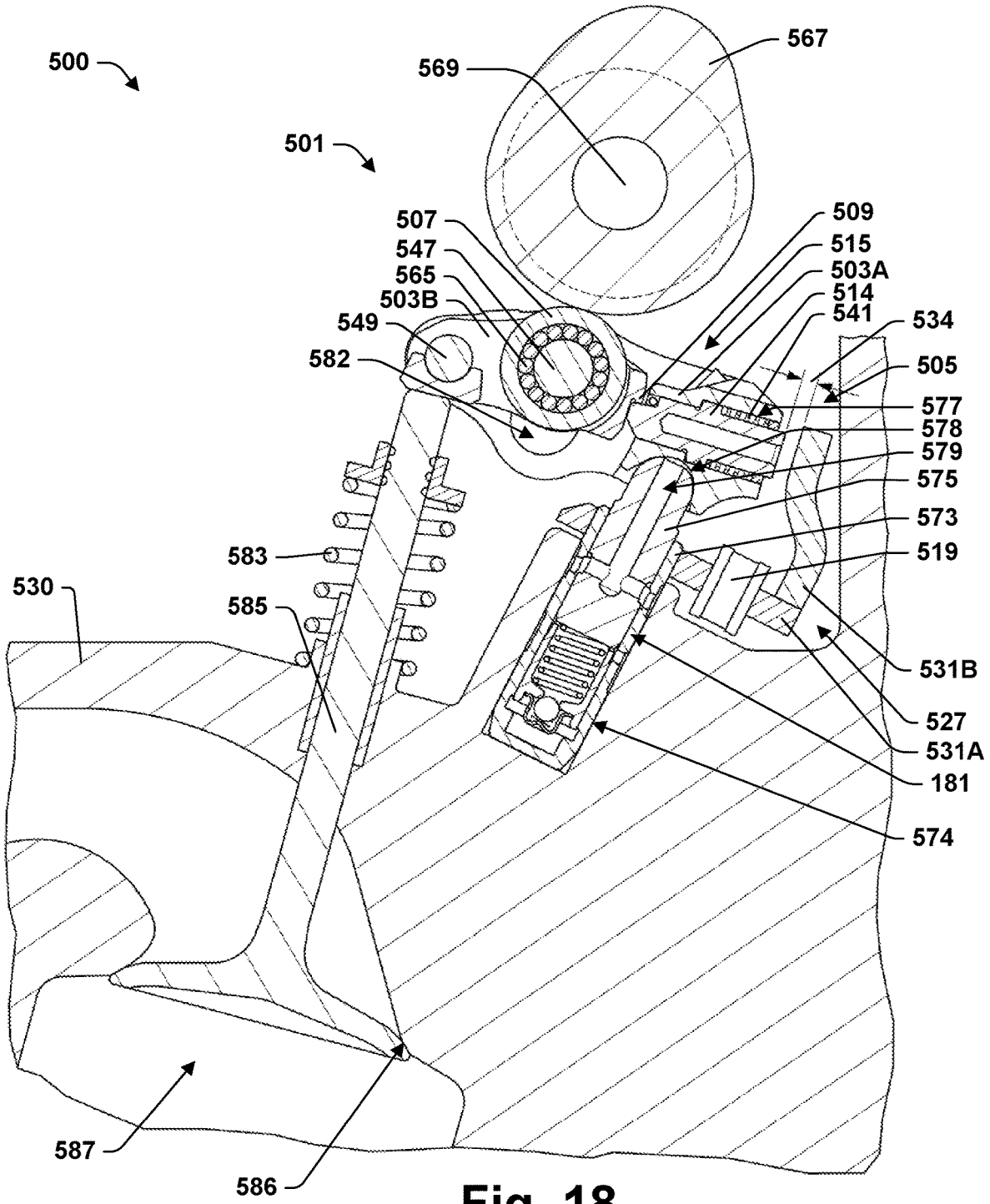
FIG. 18 is a partial cross-section of an internal combustion engine with a valvetrain according to some aspects of the present teachings.

FIG. 18 provides a partial-cutaway side view of a portion of an engine 500 including a valvetrain 501 in accordance with some aspects of the present teachings. Engine 500 includes a cylinder head 530 in which a combustion chamber 537 is formed, a moveable valve 585 having a seat 586 formed within combustion chamber 537, and a camshaft 569 on which a cam 567 is mounted. Moveable valve 585 may be a poppet valve. Valvetrain 501 includes rocker arm assembly 515, hydraulic lash adjuster (HLA) 581, and latch assembly 505. Rocker arm assembly 515 includes rocker arm 503A (an outer arm) and rocker arm 503B (an inner arm). HLA 581 is an example of a pivot. It provides a fulcrum on which rocker arm 503A pivots. Outer arm 503A and inner arm 503B are pivotally connect through shaft 549. A cam follower 507 may be mounted to inner arm 503B through bearings 565 and shaft 547. Cam follower 507 is configured to engage cam 567 as camshaft 569 rotates. Cam follower 507 is a roller follower but could alternatively be another type of cam follower such as a slider.

Figure 21:
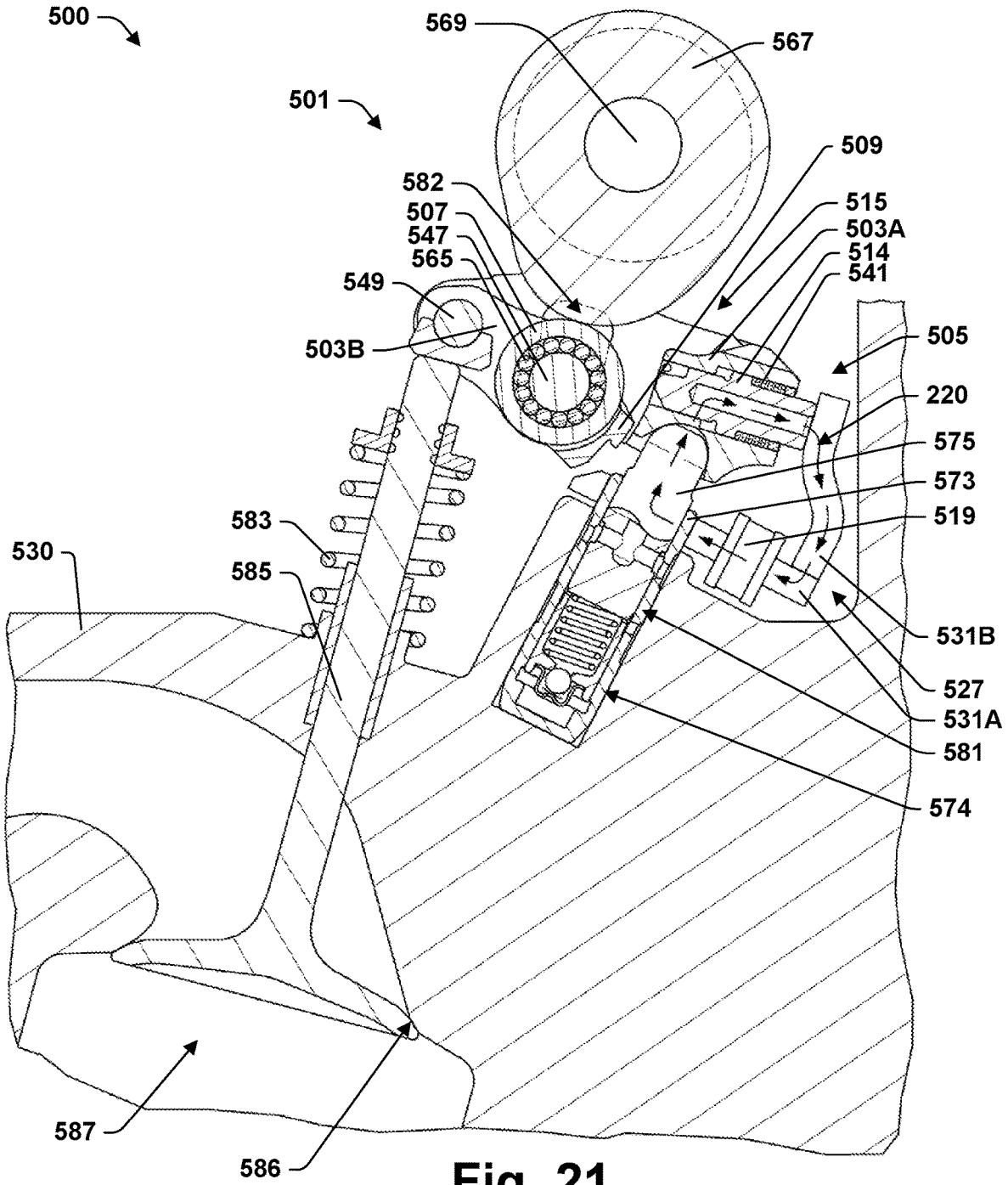
FIG. 21 is the same view as FIG. 19, but with the cam risen off base circle.

Shaft 547 protrudes outward through openings 182 in the sides of outer arm 503A where it engages torsion springs 545 (see FIG. 22), which are mounted to outer arm 503A. If inner arm 503B pivots downward relative to outer arm 503A on shaft 549 as shown in FIG. 21, torsion springs 545 act on shaft 547 to drive inner arm 503B to pivot back toward the position shown in FIG. 18.

Latch assembly 105A includes an actuator 527 mounted to HLA 581 and a latch pin 524 mounted on rocker arm 503A. In this specification, the terms "latch pin" and "rocker arm" encompass the most basic structure that would be commonly understood as constituting a "latch pin" or a "rocker arm" and may further encompass parts that are rigid and rigidly held to that most basic structure. A rocker arm assembly is operative to form one or more force transmission pathways between a cam and a moveable valve. A rocker arm is a lever operative to transmits force from the cam along one or more of those pathways. The most basic structure of the rocker arm, which is its core structure, is capable of bearing the load and carrying out that function.

Figure 19:
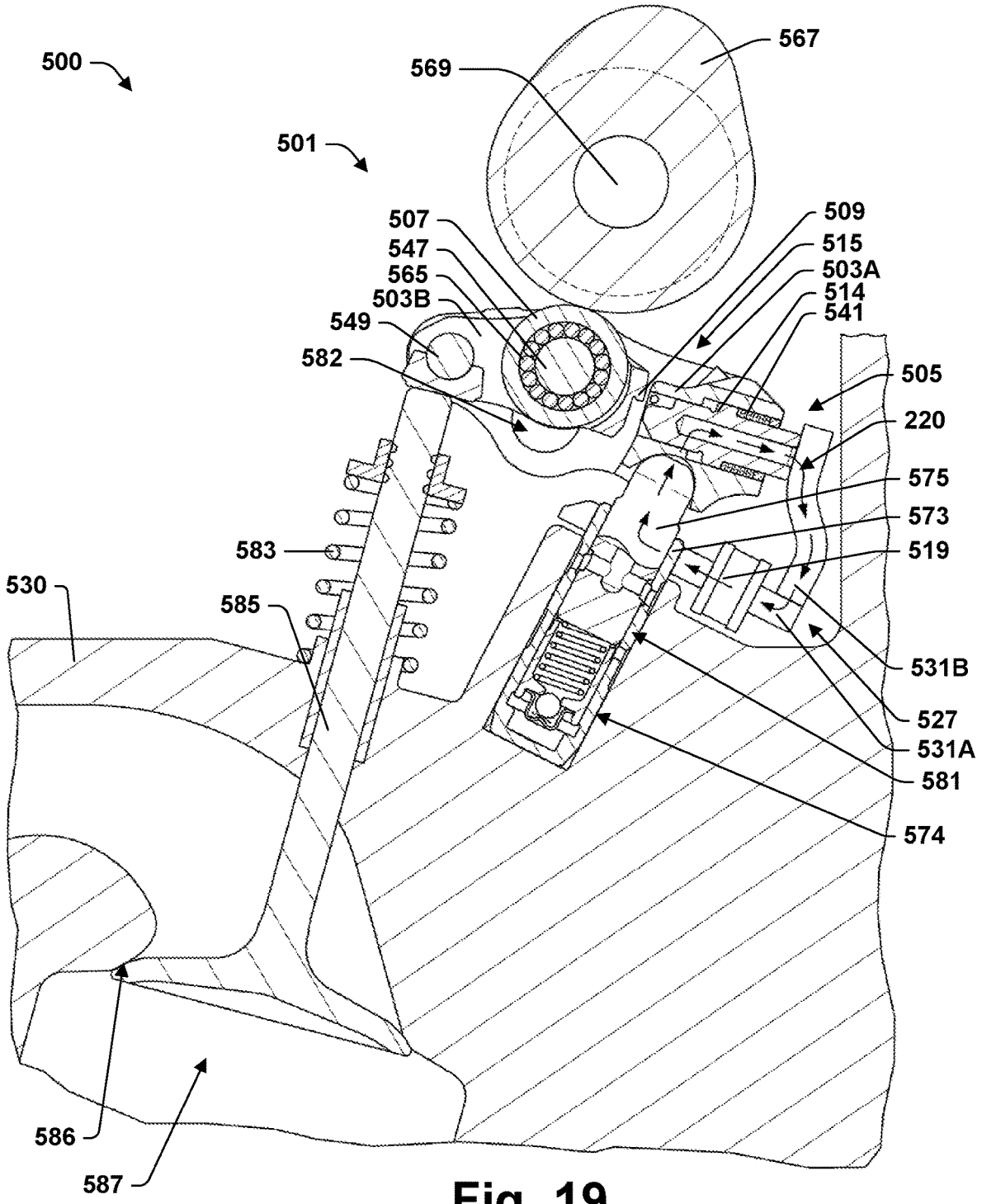
FIG. 19 is the same view as FIG. 18, but with the latch pin moved from an engaging to a non-engaging position.

Latch pin 524 is translatable between a first position and a second position. The first position may be an engaging position, which is illustrated in FIG. 18. The second position may be a non-engaging position, which is illustrated in FIG. 19. A spring 541 mounted within outer arm 503A may be configured to bias latch pin 524 into the engaging position. When latch pin 524 is in the engaging position, rocker arm assembly 515 may be described as being in an engaging configuration. When latch pin 524 is in the non-engaging position, rocker arm assembly 515 may be described as being in a non-engaging configuration.

Figure 20:
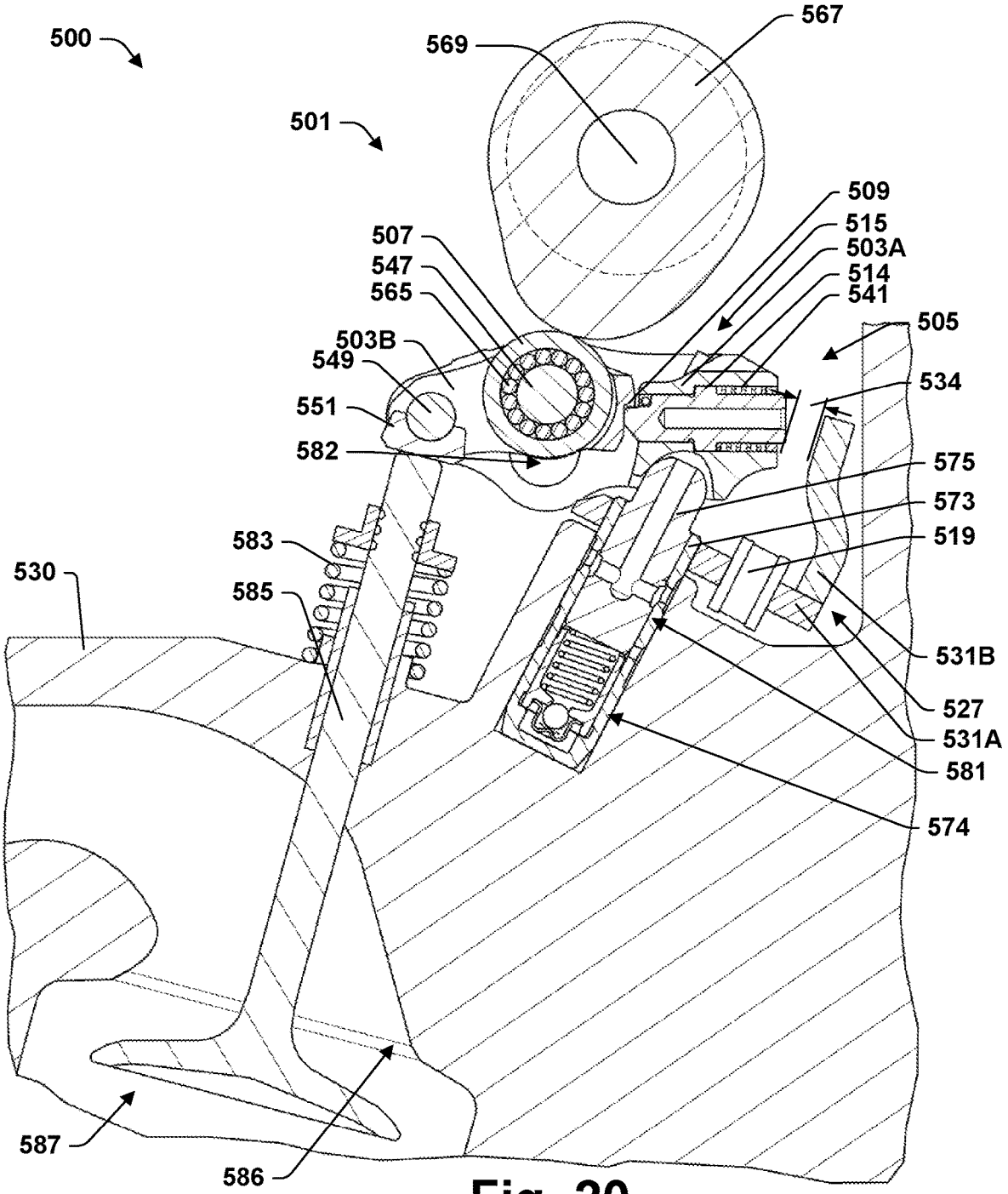
FIG. 20 is the same view as FIG. 18, but with the cam risen off base circle.

FIG. 20 shows the effect if cam 567 rises off base circle while latch pin 524 is in the engaging position. Latch pin 524 may engage lip 509 of inner arm 503B, after which inner arm 503B and outer arm 503A may be constrained to move in concert. HLA 581 may provide a fulcrum on which inner arm 503B and outer arm 503A pivot together as a unit, driving down on valve 585 via an elephant's foot 551, compressing valve spring 583 against cylinder head 530, and lifting valve 585 off its seat 586 within combustion chamber 537 with a valve lift profile determined by the shape of cam 567. The valve lift profile is the shape of a plot showing the height by which valve 585 is lifted of its seat 586 as a function of angular position of camshaft 569.

FIG. 21 shows the effect if cam 567 rises off base circle while latch pin 524 is in the non-engaging position. Cam 567 still drives inner arm 503B downward, but instead of compressing valve spring 583, inner arm 503B pivots on shaft 549 against the resistance of torsion springs 545. Torsion springs 545 yield more easily than valve spring 583. Outer arm 503A remains stationary and valve 585 remains on its seat 586. Accordingly, the non-engaging configuration may provide deactivation of a cylinder with a port controlled by valve 585. Alternatively, there may be additional cams that operate directly on outer arm 503A. These additional cams may provide a lower valve lift profile than cam 567. Therefore, the non-engaging configuration for rocker arm assembly 515 may provide an alternate valve lift profile and rocker arm assembly 515 may provide a switching rocker arm.

Actuator 527 may include an electromagnet 519 and pole pieces 531A and 531B. Actuator 527 is mounted to HLA 581 through pole piece 531A, which also provides a core for electromagnet 519. HLA 581 includes an inner sleeve 575 and an outer sleeve 573. Outer sleeve 573 is installed within a bore 574 formed in cylinder head 530. Outer sleeve 573 may rotate within bore 574, but is otherwise substantially stationary with respect to cylinder head 530. Inner sleeve 575 is telescopically engaged within outer sleeve 573 and provides a fulcrum on which outer arm 503A pivots. That fulcrum may be hydraulically raised or lowered to adjust lash.

Latch pin 524, outer arm 503A, inner sleeve 575, and outer sleeve 573 may be made entirely of low coercivity ferromagnetic material. Together with pole pieces 531A and 531B, they may form a magnetic circuit 520, which is shown in FIG. 19. A magnetic circuit is a structure operative to be the pathway for an operative portion of the magnetic flux from a magnetic flux source. Magnetic circuit 520 provides a pathway for magnetic flux that is generated by electromagnet 519 and is operative to actuate latch pin 524 from its engaging to its non-engaging position. When electromagnet 519 is first energized, magnetic circuit 520 includes the air gap 534, which is shown in FIG. 18. Energizing electromagnet 519 generates magnetic flux that polarizes low coercivity ferromagnetic materials within circuit 520 and results in magnetic forces on latch pin 524 that tend to drive it to the non-engaging position shown in FIG. 19. Driving latch pin 524 to the non-engaging configuration reduces air gap 534 and the magnetic reluctance in circuit 520. If electromagnet 519 is switched off, spring 541 may drive latch pin 524 back into the engaging configuration and reopen air gap 534.

Magnetic circuit 520 passes through rocker arm 503A. In this disclosure, "passing through" a part means passing through the smallest convex volume that can enclose the part. When asserting that a magnetic flux that is operative "passes through" a part, the meaning is that the entirety of a portion of the magnetic flux that is sufficient to be operative passes through that part. In other words, the operability is achieved independently from any flux that follows a circuit that does not pass through the part.

Magnetic circuit 520 passes through the structure of rocker arm 503A. "Passing through the structure" of a part means passing through the material that makes up that part. If the part forms a low reluctance pathway for the magnetic flux, it may help define the magnetic circuit. Low coercivity ferromagnetic materials in particular are useful in establishing magnetic circuits. In some cases, the magnetic properties of a part are essential to the formation of a magnetic circuit through which actuator 527 is operative. A touchstone for these cases is that if that part were replaced by an aluminum part, an operability dependent on that circuit would be lost. Aluminum is an example of a paramagnetic material. For the purposes of this disclosure, a paramagnetic material is one that does not interact strongly with magnetic fields.

HLA 581 and latch pin 524 form an essential part of magnetic circuit 520. In other words, if either of these parts were replaced by ones made entirely of aluminum, actuator 527 would cease to be operative to actuate latch pin 524. Depending on the strength of electromagnet 509, the core structure of rocker arm 503A may also form an essential part of magnetic circuit 520. Rocker arm 503A may be formed of low coercivity ferromagnetic material that provides a low reluctance pathway for magnetic flux crossing from HLA 581 to latch pin 524. On the other hand, HLA 581 brings magnetic flux sufficiently close to latch pin 524 that magnetic flux may cross between HLA 581 and latch pin 524 following magnetic circuit 520 regardless of the material in between. In some of these teachings, pole pieces 592L are positioned to the sides of rocker arm 503A as illustrated in FIG. 22 to facilitate transmission of magnetic flux from HLA 581 to latch pin 524 within rocker arm 503A.

Latch pin 524, by virtue of being mounted to outer arm 503A, has a range of motion relative to combustion chamber 537 and actuator 527. This range of motion may be primarily the result of outer arm 503A pivoting on HLA 581 when rocker arm assembly 515 is in the engaging configuration. On the other hand, the position of latch 517 relative to actuator 527 may be substantially fixed while latch 517 is in the non-engaging configuration. Extension and retraction of HLA 581 may introduce some relative motion but, excluding a brief period during start-up, the range of motion introduced by HLA 581 may be negligible. As long as latch pin 524 is in the non-engaging configuration, magnetic circuit 520 may remain operative whereby electromagnet 519 may act through that circuit to maintain latch pin 524 in the non-engaging configuration.

Figure 22:
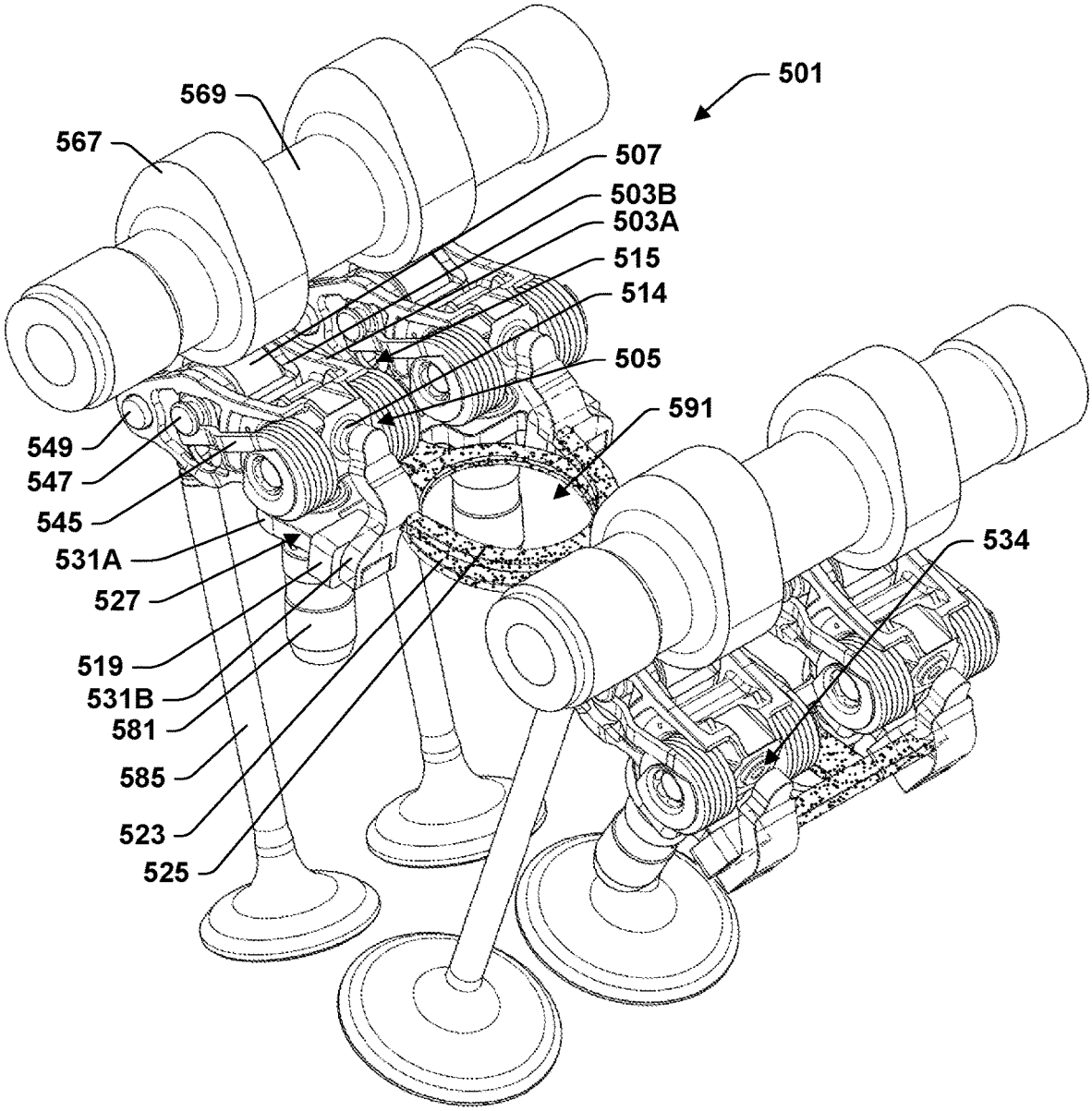
FIG. 22 provides a perspective view of a portion of the valvetrain of the engine illustrated by FIG. 18.
Figure 23:
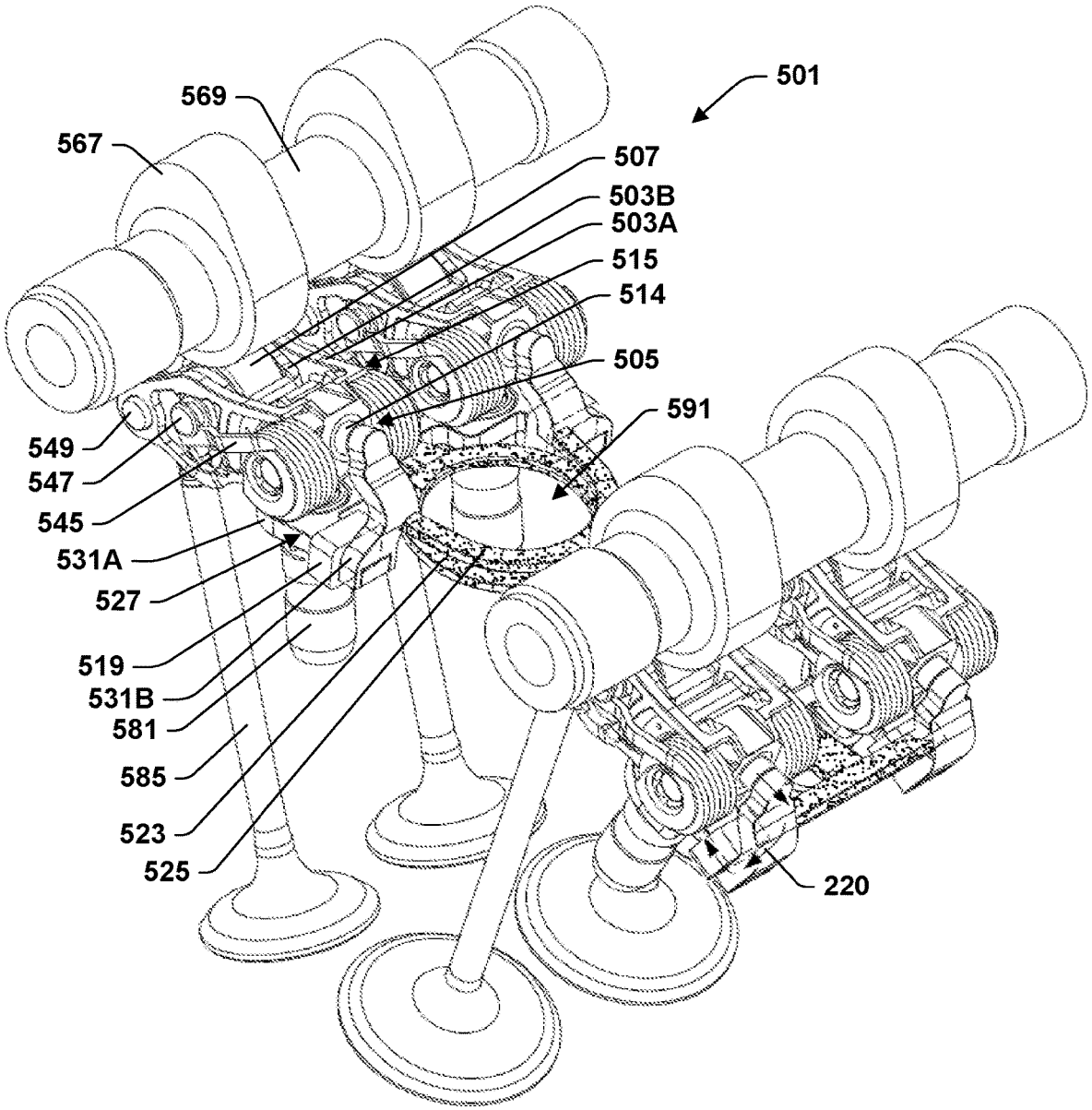
FIG. 23 provides the same view as FIG. 22, but with the latch pins moved from engaging to non-engaging positions.

FIGS. 22 and 23 are perspective views of a portion of the valvetrain 501, which is in accordance with some aspects of the present teachings and is a part of engine 500. As shown by these illustrations, actuator 527 may be one of four supported by a common framework 523. The four actuators 527 may control two intake ports and two exhausts ports for one engine cylinder. Framework 523 may include four pole pieces 531A joined with a paramagnetic connecting structure 522. Framework 523 has an opening 591 that fits around a spark plug tube. Framework 523 may rest atop cylinder head 530 with opening 591 aligned with an opening in cylinder head 530 that receives the spark plug tube (not shown).

Figure 24:
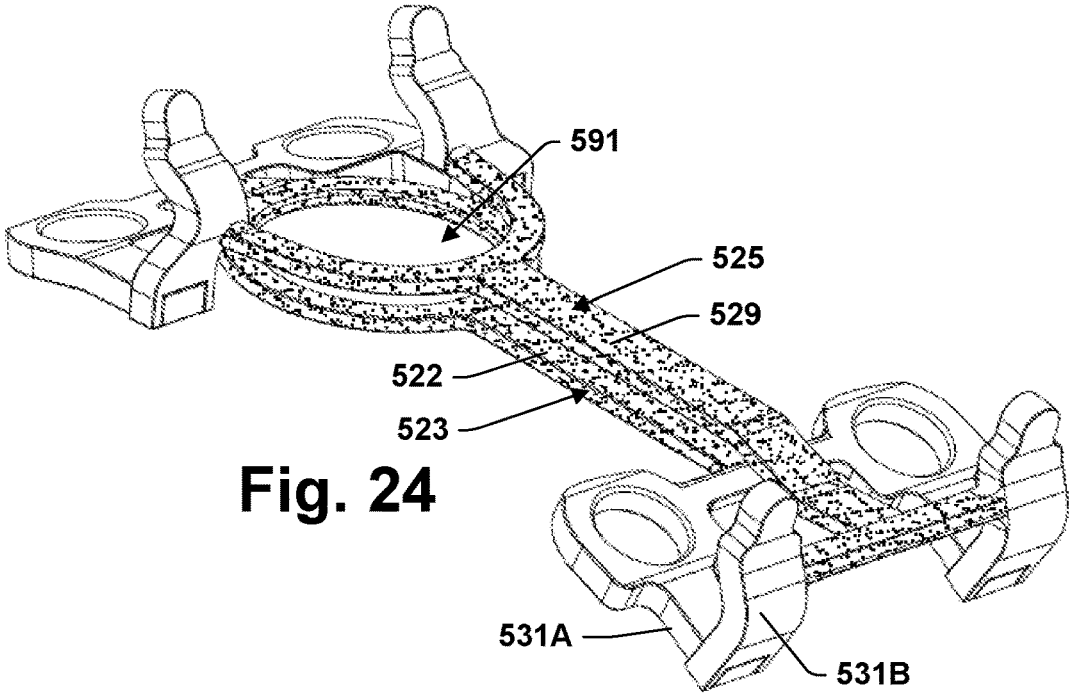
FIG. 24 provides a perspective view of a framework according to some aspects of the present teachings, which is used in the valvetrain of FIG. 22.
Figure 25:
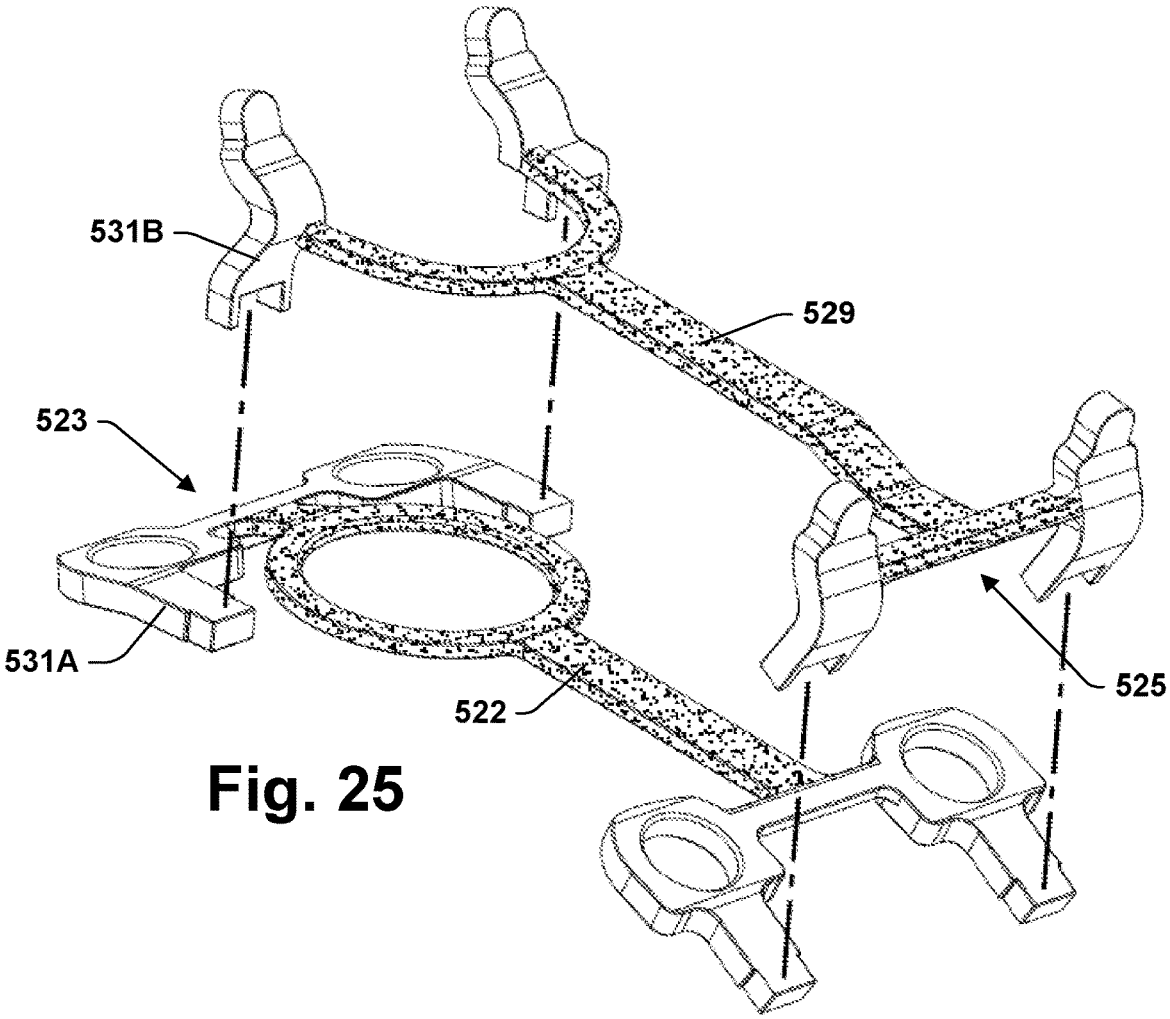
FIG. 25 provides an explode view of the framework of FIG. 24.
Figure 26:
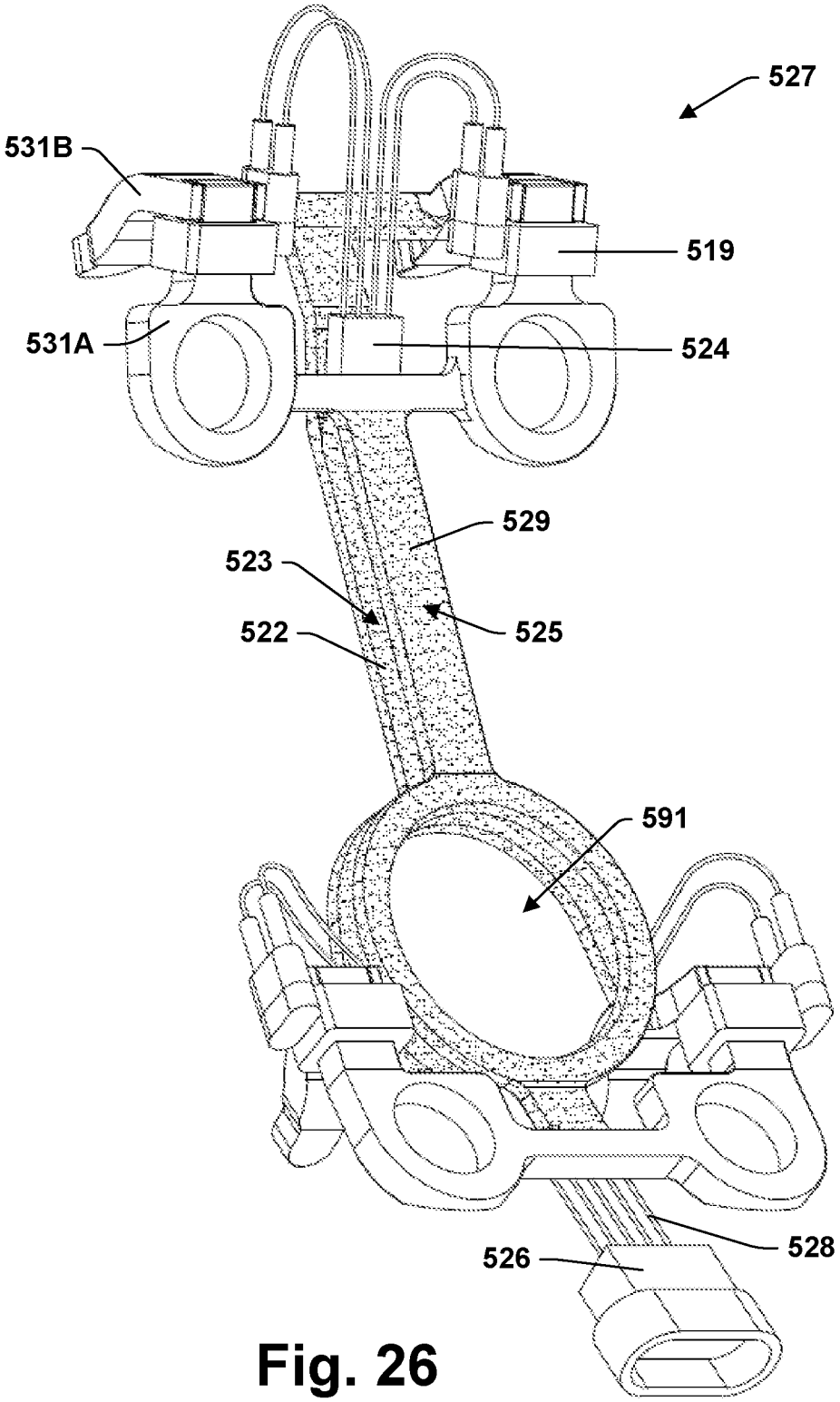
FIG. 26 provide a perspective view of the framework of FIG. 24 with four electromagnets and associated pole pieces attached thereto.

As shown in FIGS. 24-26, framework 523 may have a lower frame 522 that join with an upper frame 525. A wiring harness 524 including wires 528 that provide power to electromagnets 519 may be mounted to framework 523. Lower frame 522 supports wiring harness 524 from below. Upper frame 525 may protect wires 528 from objects falling from above during manufacturing or maintenance. Upper frame 525 may include four pole pieces 531B and a paramagnetic connecting structure 529. When framework 523 is installed in engine 500 with opening 591 around a spark plug tube, framework 523 holds pole pieces 531B in close proximity with rocker arm assemblies 515 with a precision that enhances the operation of actuators 527. Pole pieces 531A fit around pivots 581 and thereby locate framework 523 against pivots 581. Framework 523 may be further secured with connectors attaching frame 523 to cylinder head 530.

Wires 528 may all connect to a common plug 526, which attached to framework 523 at a location proximate opening 591. In some of these teachings, two of the electromagnets 519 are connected in series or in parallel. In some of these teachings, all four of the electromagnets 519 are connected in series or in parallel. These options reduce the number of wires in plug 526 and allowing a tradeoff between circuit costs and flexibility. For example, the intake and exhaust valves in a multi-valve engine may only be subject to deactivation in pairs.

Framework 523 may be part of a valve actuation module that includes a rocker arm assembly 515 and an actuator 527. The actuator 527 may be mounted to a pivot for the rocker arm assembly 515. For example, the actuator 527 may be mounted to an HLA 581. In some of these teachings, the HLA 581 and the rocker arm assembly 515 are held together by a removable clip (not shown). The clip may hold HLA 581 and rocker arm assembly 515 together during shipping and through installation of valve actuation module within an engine 500.

The components and features of the present disclosure have been shown and/or described in terms of certain teachings and examples. While a particular component or feature, or a broad or narrow formulation of that component or feature, may have been described in relation to only some aspects of the present teachings or some examples, all components and features in either their broad or narrow formulations may be combined with other components or features to the extent such combinations would be recognized as logical by one of ordinary skill in the art.

The invention claimed is:

1. A valvetrain for an internal combustion engine of a type that has a combustion chamber, a moveable valve having a seat formed in the combustion chamber, and a camshaft, comprising:

a rocker arm assembly comprising a rocker arm;

an electromagnetic latch assembly including an electromagnet and a latch pin; and a framework that supports a conductor that is part of a circuit that includes the electromagnet;

wherein the framework holds a component of the electromagnetic latch assembly adjacent the rocker arm assembly;

the electromagnet is mounted to the framework; and the electromagnet is operable to cause the latch pin to translate between a first position and a second position through a magnetic flux that passes between the rocker arm assembly and the component of the electromagnetic latch assembly held adjacent the rocker arm assembly by the framework;

wherein the electromagnet is operable to cause the latch pin to translate between the first position and the second position through the magnetic flux that passes through the rocker arm;

one of the first position and the second position provides a configuration in which the rocker arm assembly is operative to actuate the moveable valve in response to rotation of the camshaft to produce a first valve lift profile; and the other of the first position and the second position provides a configuration in which the rocker arm assembly is operative to actuate the moveable valve in response to rotation of the camshaft to produce a second valve lift profile, which is distinct from the first valve lift profile, or the moveable valve is deactivated.

2. The valvetrain of claim 1, wherein the framework abuts a pivot for the rocker arm assembly.

3. The valvetrain of claim 1, wherein the framework is shaped to abut a pivot for the rocker arm assembly and a spark plug tube distal from the pivot while holding the component of the electromagnetic latch assembly adjacent the rocker arm assembly.

4. The valvetrain of claim 1, wherein the framework is shaped to wrap around a spark plug tube while holding the component of the electromagnetic latch assembly adjacent the rocker arm assembly.

5. The valvetrain of claim 1, wherein the component is a pole piece for the electromagnet.

6. The valvetrain of claim 1, wherein the electromagnetic latch assembly provides the latch pin with positional stability independently from the electromagnet when the latch pin is in the first position and when the latch pin is in the second position.

7. An internal combustion engine, comprising:

a cylinder head comprising a spark plug tower having an opening;

a spark plug tube installed within the opening;

a valvetrain including a rocker arm assembly comprising a rocker arm;

an electromagnetic latch assembly comprising an electromagnet that configures the rocker arm assembly; and a framework that holds a component of the electromagnetic latch assembly in a position adjacent the rocker arm assembly;

wherein the framework rests on the spark plug tower and the spark plug tube protrudes upward through an opening in the framework.

8. The internal combustion engine of claim 7, wherein the framework supports a conductor that is part of a circuit that includes the electromagnet.

9. The internal combustion engine of claim 7, wherein the component is a pole piece for the electromagnet.

10. The internal combustion engine of claim 7, wherein the component provides electrical power to the electromagnet.

11. The internal combustion engine of claim 10, wherein the electromagnet is mounted to the rocker arm.

12. The internal combustion engine of claim 7, wherein the framework holds the component in abutment with a distinct part that is mounted to the rocker arm.

13. An internal combustion engine, comprising:

a cylinder head;

a valve cover;

a spark plug tube extending from the cylinder head through the valve cover; and a valvetrain comprising:

a rocker arm assembly comprising a rocker arm;

an electrical device; and a circuit that includes the electrical device;

wherein the circuit comprises a wire that enters the spark plug tube below the cylinder head and exits the spark plug tube above the cylinder head.

14. The internal combustion engine of claim 13, wherein the electrical device is an electromagnet that configures the rocker arm assembly.

15. The internal combustion engine of claim 14, further comprising:

a framework;

wherein the electromagnet is part of an electromagnetic latch assembly;

the framework holds a component of the electromagnetic latch assembly adjacent the rocker arm assembly; and the framework abuts the spark plug tube.

16. The internal combustion engine of claim 13, further comprising:

a framework that supports a conductor that is part of the circuit;

wherein the framework abuts the spark plug tube.

17. The internal combustion engine of claim 13, further comprising:

a framework that supports a conductor that is part of the circuit;

wherein the framework wraps around the spark plug tube.

18. The internal combustion engine of claim 13, further comprising:

a framework that supports a conductor that is part of the circuit;

wherein the framework abuts the spark plug tube.

19. The internal combustion engine of claim 18, wherein:

the valvetrain further comprises a pivot for the rocker arm assembly; and the framework abuts the pivot.

* * * * *